US012703592B2

(12) United States Patent
Onoue et al.

(10) Patent No.: US 12,703,592 B2
(45) Date of Patent: Aug. 11, 2026

(54) MEDIUM SUPPLY DEVICE AND IMAGE FORMING APPARATUS

(71) Applicant: FUJIFILM Business Innovation Corp., Tokyo (JP)

(72) Inventors: Yohei Onoue, Kanagawa (JP); Yuichi Araki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 432 days.

(21) Appl. No.: 18/188,466

(22) Filed: Mar. 23, 2023

(65) Prior Publication Data

US 2024/0101371 A1 Mar. 28, 2024

(30) Foreign Application Priority Data

Sep. 28, 2022 (JP) ..... 2022-154409

(51) Int. Cl.
*B65H 3/14* (2006.01)
*B65H 5/22* (2006.01)
*B65H 7/02* (2006.01)

(52) U.S. Cl.
CPC ..... *B65H 3/14* (2013.01); *B65H 5/228* (2013.01); *B65H 7/02* (2013.01); *B65H 2403/54* (2013.01); *B65H 2551/11* (2013.01); *B65H 2801/03* (2013.01)

(58) Field of Classification Search
CPC . B65H 3/14; B65H 5/228; B65H 7/02; B65H 2403/54; B65H 2551/11; B65H 2801/03
See application file for complete search history.

(56) References Cited

U.S. PATENT DOCUMENTS 5,609,333 A * 3/1997 Mandel ..... B65H 43/06 270/58.11
9,199,810 B2 12/2015 Shimoyama et al.
2019/0233226 A1* 8/2019 Nakamura ..... B65H 3/48
2021/0163246 A1* 6/2021 Nakano ..... G03G 15/6502
2022/0082977 A1* 3/2022 Maeda ..... G03G 15/6529

FOREIGN PATENT DOCUMENTS

JP 2010-126296 * 6/2010
JP 2015024868 2/2015

* cited by examiner

*Primary Examiner* — Thomas A Morrison
(74) *Attorney, Agent, or Firm* — JCIPRNET

(57) ABSTRACT

A medium supply device includes: a stacking unit in which media are stackable in a vertical direction; a first regulating unit that is provided on the stacking unit and that regulates positions of side portions of the media in a width direction; a supply unit that supplies air to more than one of the media stacked on the stacking unit so that the more than one of the media are raised and separated from each other; a transport unit that successively feeds the media that are raised and separated from each other by the supply unit; a detection unit that detects conditions of the media that are raised and separated from each other by the supply unit from outside in the width direction; a second regulating unit that is attached to an upper section of the stacking unit when the media stacked in the stacking unit are second media and that regulates positions of side portions of the second media in the width direction, the second media having a smaller dimension than first media in the width direction; and a moving unit that moves the detection unit to an area in which the second media are detectable when the second regulating unit is attached.

18 Claims, 19 Drawing Sheets

MEDIUM SUPPLY DEVICE AND IMAGE FORMING APPARATUS

CROSS-REFERENCE TO RELATED APPLICATIONS

This application is based on and claims priority under 35 USC 119 from Japanese Patent Application No. 2022-154409 filed Sep. 28, 2022.

BACKGROUND

(i) Technical Field

The present disclosure relates to a medium supply device and an image forming apparatus.

(ii) Related Art

Japanese Unexamined Patent Application Publication No. 2015-024868 describes a sheet supply apparatus including: a placement unit on which a sheet stack including a plurality of sheets stacked in a vertical direction is placeable; a blowing unit that blows air against the sheet stack placed on the placement unit to raise at least an uppermost one of the sheets; a suction transport unit disposed above the placement unit, the suction transport unit holding, by suction, the uppermost one of the sheets raised by the blowing unit and transporting the uppermost one of the sheets in a predetermined transporting direction; a first light source that emits first slit light that is strip-shaped and that includes a component extending in the vertical direction, the first slit light crossing at least a first edge of a first sheet and a second edge of a second sheet below the first sheet, the first sheet and the second sheet being included in more than one of the sheets that are raised; an imaging unit that captures an image of the first slit light with which the first sheet and the second sheet are illuminated, the imaging unit having an image capturing direction that differs from a direction in which the first slit light is emitted from the first light source on a plane parallel to the first sheet and the second sheet; a calculating unit that calculates a vertical gap between the first sheet and the second sheet based on the image of the first slit light captured by the imaging unit; and a flow-rate adjusting unit that adjusts a flow rate of the blowing unit based on the vertical gap between the first sheet and the second sheet calculated by the calculating section.

SUMMARY

Aspects of non-limiting embodiments of the present disclosure relate to a medium supply device and an image forming apparatus in which conditions of narrow media that are raised and separated from each other may be detected more accurately than when the position of a detection unit is not changed upon attachment of a second regulating unit that regulates positions of side portions of the narrow media in a width direction, the narrow media having a smaller dimension than other media in the width direction.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium supply device including: a stacking unit in which media are stackable in a vertical direction; a first regulating unit that is provided on the stacking unit and that regulates positions of side portions of the media in a width direction; a supply unit that supplies air to more than one of the media stacked on the stacking unit so that the more than one of the media are raised and separated from each other; a transport unit that successively feeds the media that are raised and separated from each other by the supply unit; a detection unit that detects conditions of the media that are raised and separated from each other by the supply unit from outside in the width direction; a second regulating unit that is attached to an upper section of the stacking unit when the media stacked in the stacking unit are second media and that regulates positions of side portions of the second media in the width direction, the second media having a smaller dimension than first media in the width direction; and a moving unit that moves the detection unit to an area in which the second media are detectable when the second regulating unit is attached.

BRIEF DESCRIPTION OF THE DRAWINGS

Exemplary embodiments of the present disclosure will be described in detail based on the following figures, wherein.

DETAILED DESCRIPTION

Figure 1A:
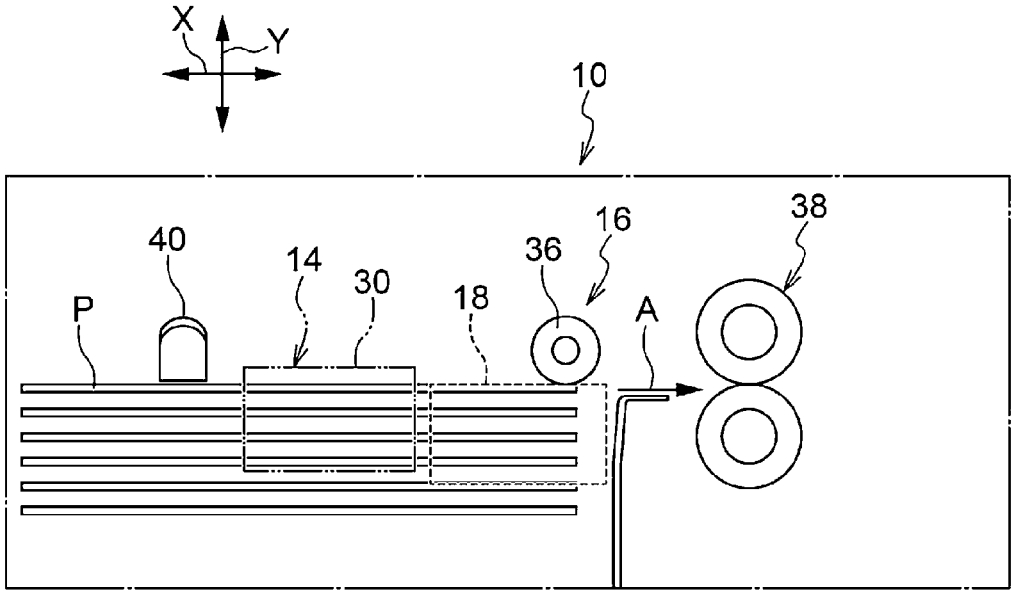
FIG. 1A is a front view of a part of a medium supply device according to a first exemplary embodiment.

Exemplary embodiments of the present disclosure will now be described. In the following description, the direction shown by arrow X in the drawings is defined as an apparatus width direction, and the direction shown by arrow Y in the drawings as an apparatus height direction. The direction orthogonal to the apparatus width direction and the apparatus height direction (direction shown by arrow Z) is defined as an apparatus depth direction.

First Exemplary Embodiment

Figure 1B:
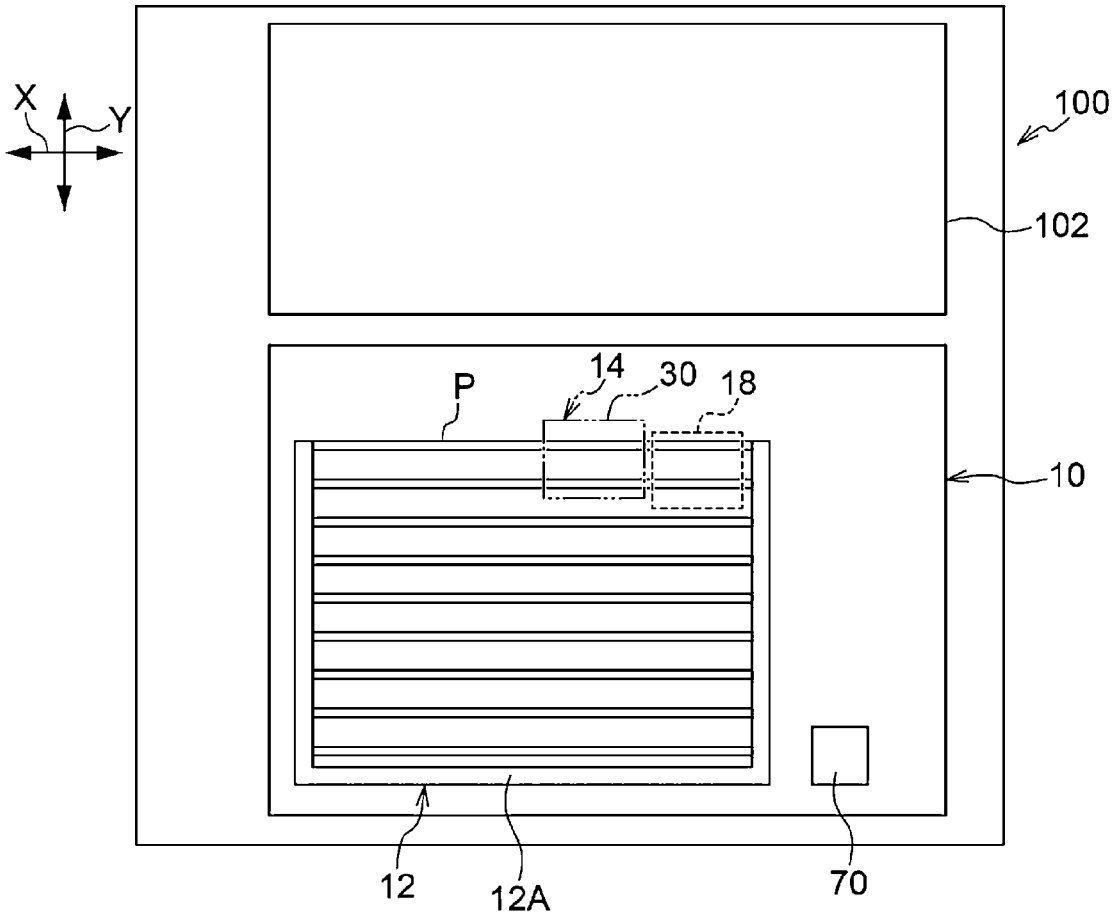
FIG. 1B is a schematic diagram illustrating an example of an image forming apparatus including the medium supply device.

FIG. 1A illustrates a part of a medium supply device 10 according to a first exemplary embodiment, and FIG. 1B illustrates an example of an image forming apparatus 100 including the medium supply device 10.

Structure of Image Forming Apparatus

As illustrated in FIG. 1B, the image forming apparatus 100 includes an image forming unit 102 that forms images on paper sheets P, which are examples of media, and a medium supply device 10 that supplies the paper sheets P to the image forming unit 102 one at a time. Although not illustrated, a transporting unit that transports the paper sheets P to an image forming position is provided in the image forming unit 102. The structure and arrangement of the image forming unit 102 and the transporting unit are not particularly limited. The medium supply device 10 may be configured to be optionally attachable to a body of the image forming apparatus 100.

Structure of Medium Supply Device

Overall Structure

As illustrated in FIGS. 1A and 1B, the medium supply device 10 includes a stacking unit 12 in which paper sheets P are stackable in a vertical direction and a supply unit 14 that supplies air to the paper sheets P in the stacking unit 12 so that the paper sheets P are raised and separated from each other. The medium supply device 10 also includes a transport unit 16 that successively feeds the paper sheets P raised and separated from each other by the supply unit 14, and a camera 18 that is an example of a detection unit that detects conditions of the paper sheets P raised and separated from each other by the supply unit 14. The camera 18 may, for example, be provided at each side of the paper sheets P in the width direction (direction of arrow Z). The medium supply device 10 also includes a controller 70 that controls operations of components of the medium supply device 10. The controller 70 is an example of a processor.

Figure 2:
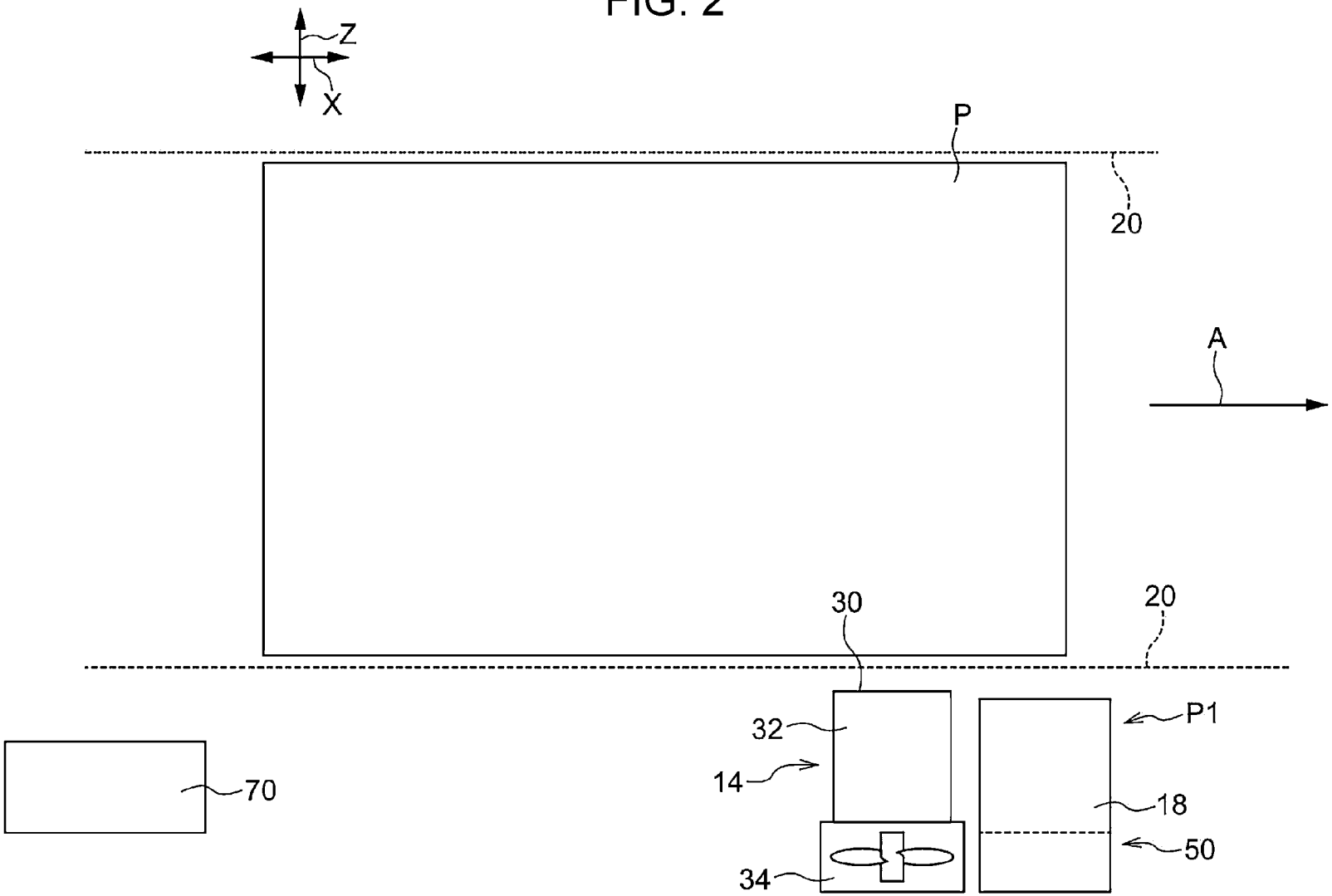
FIG. 2 is a plan view of a part of the medium supply device according to the first exemplary embodiment.
Figure 3:
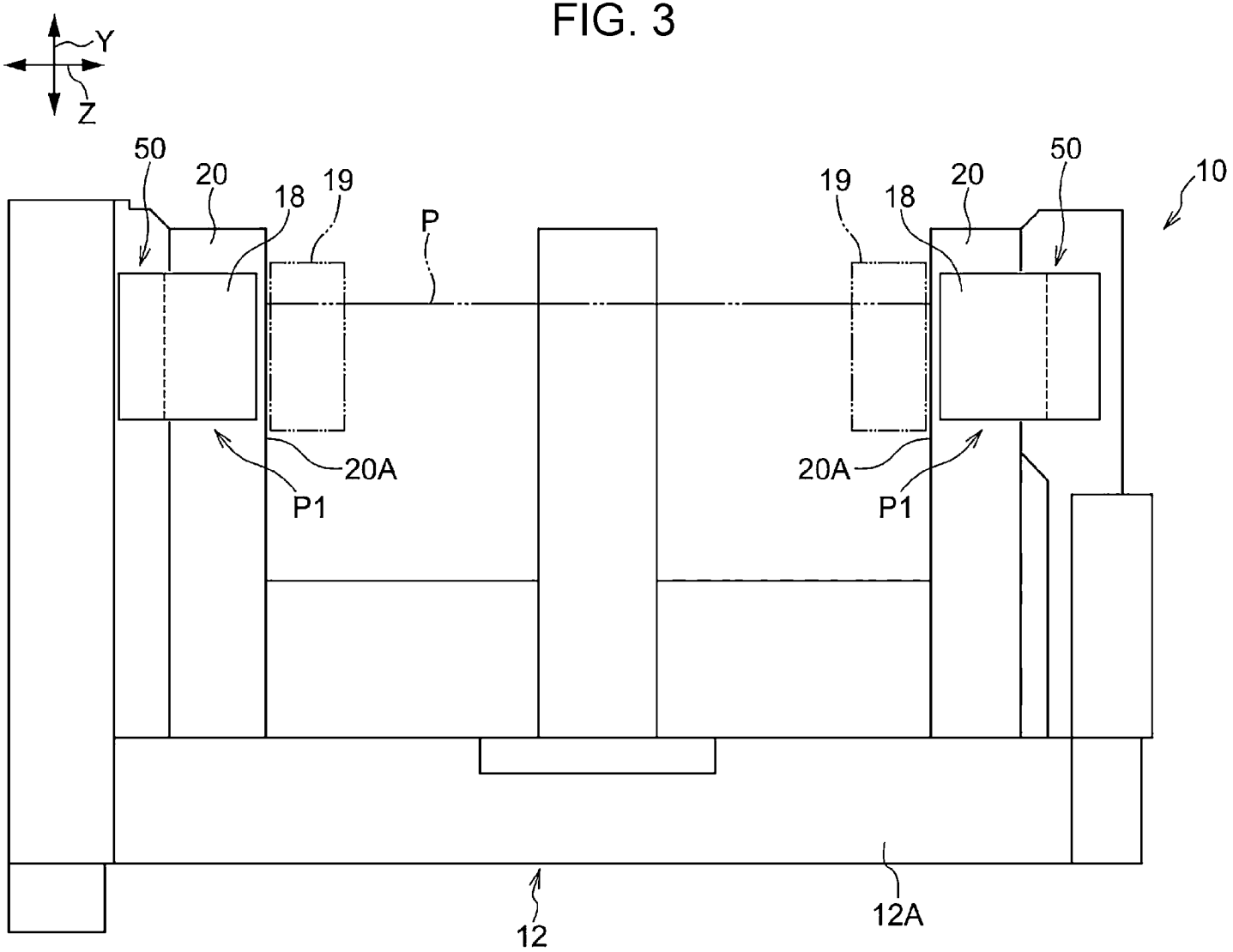
FIG. 3 is a side view of the medium supply device according to the first exemplary embodiment viewed in a direction in which paper sheets are fed.
Figure 4:
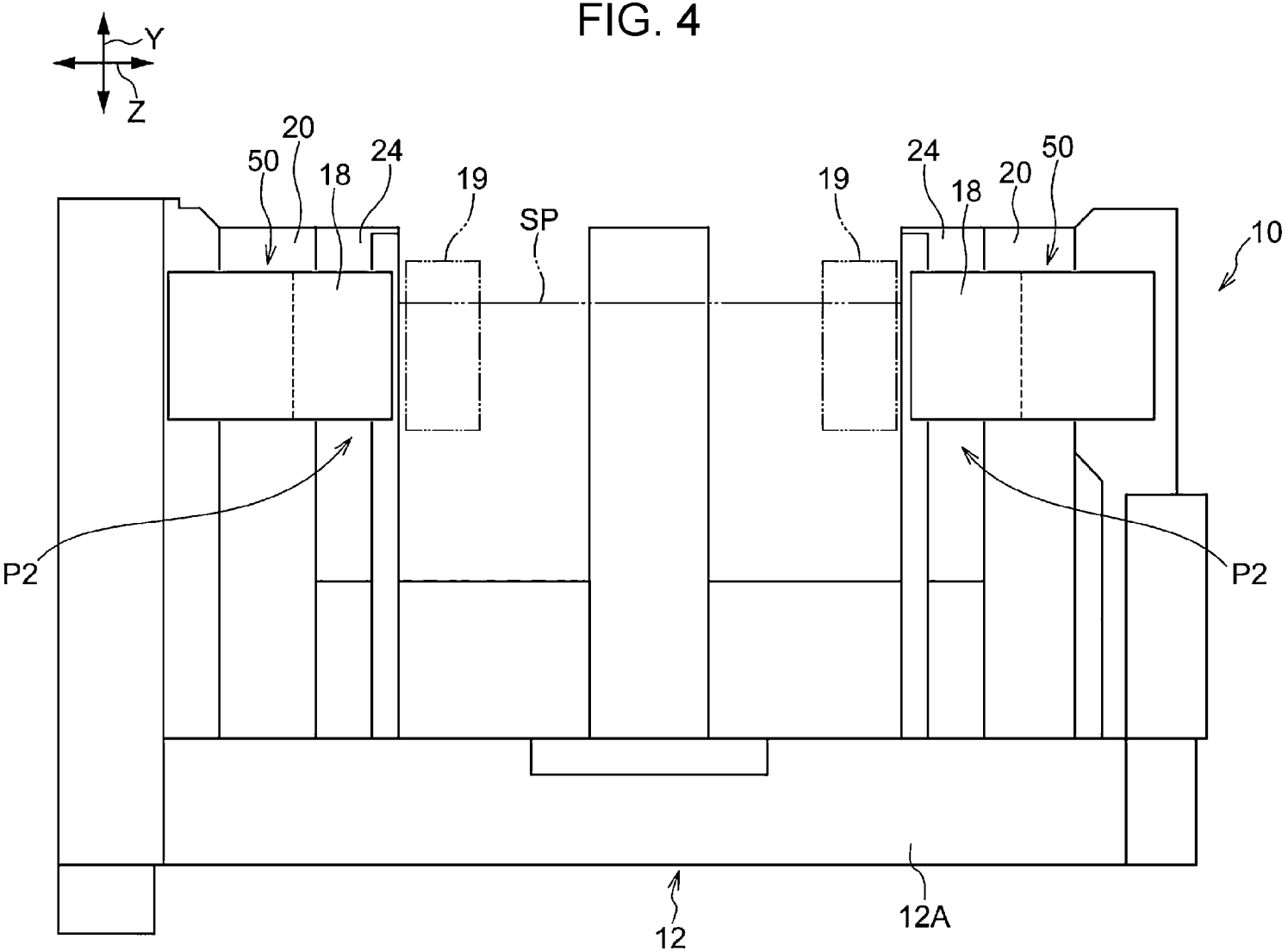
FIG. 4 is a side view of the medium supply device according to the first exemplary embodiment in which small-paper-sheet guides are attached to side guides.

As illustrated in FIGS. 2 and 3, the medium supply device 10 also includes side guides 20 that regulate the positions of side portions of the paper sheets P in the stacking unit 12 in the width direction (direction of arrow Z in this example). As illustrated in FIG. 4, the medium supply device 10 also includes small-paper-sheet guides 24 that are attached to an upper section of the stacking unit 12 when small paper sheets SP, which has a smaller dimension than the paper sheets P in the width direction (direction of arrow Z), are stacked. The medium supply device 10 also includes moving devices 50 that move respective cameras 18 to areas in which the small paper sheets SP are detectable when the small-paper-sheet guides 24 are attached. The side guides 20 are examples of a first regulating unit, and the small-paper-sheet guides 24 are examples of a second regulating unit. The small paper sheets SP are examples of second media. The moving devices 50 are examples of a moving unit.

The paper sheets P, which have a normal size, are examples of first media. The small paper sheets SP are paper sheets having a width less than an interval between the left and right side guides 20 when the left and right side guides 20 are closest to each other. The lower limit of the width of the small paper sheets SP is such that the small paper sheets SP are at least wider than a suction unit 40 included in the transport unit 16. The reason for this is to avoid suction failure due to leakage of air in the suction unit 40. The length of the paper sheets P in a sheet width direction along the apparatus depth direction (direction of arrow Z) is, for example, greater than or equal to the length of a B5 size sheet in a transverse direction. The length of the small paper sheets SP in the sheet width direction along the apparatus depth direction (direction of arrow Z) is, for example, less than the length of a B5 size sheet in a transverse direction. The sizes of the paper sheets P and the small paper sheets SP are changeable.

Stacking Unit

As illustrated in FIG. 1A, the stacking unit 12 includes a plate-shaped body 12A on which the paper sheets P are stackable. Although not illustrated, the medium supply device 10 includes a raising-lowering device that raises and lowers the plate-shaped body 12A in the vertical direction. The raising-lowering device raises the plate-shaped body 12A so that the uppermost one of the paper sheets P stacked on the plate-shaped body 12A is at a predetermined height.

Supply Unit

As illustrated in FIGS. 1A and 2, the supply unit 14 includes an air outlet 30 from which air is blown toward an upper section of the stacking unit 12 in a direction from a side of the paper sheets P in the width direction (direction of arrow Z). The air outlet 30 is positioned to face an upper portion of the stack of paper sheets P on the plate-shaped body 12A. The supply unit 14 causes the air outlet 30 to blow air into the spaces between the paper sheets P, so that the paper sheets P stacked on the plate-shaped body 12A of the stacking unit 12 are raised and separated from each other.

The supply unit 14 includes a duct 32 connected to the air outlet 30 and a fan 34 disposed upstream of the duct 32 in the direction of air flow (see FIG. 2). The supply unit 14 causes the fan 34 to rotate so that air is supplied to the air outlet 30 through the duct 32 and blown toward the upper section of the stacking unit 12 from the air outlet 30.

Although not illustrated, the air outlet 30 is provided at each side of the paper sheets P in the width direction (direction of arrow Z). The duct 32 is branched into two portions at a location downstream of the fan 34 in the direction of air flow, and the air outlet 30 is provided at a downstream end of each of the portions into which the duct 32 is branched.

Transport Unit

As illustrated in FIG. 1A, the transport unit 16 transports the paper sheets P on the plate-shaped body 12A of the stacking unit 12 one at a time in the direction of arrow A, that is, rightward in the apparatus width direction (rightward in the direction of arrow X). The transport unit 16 includes a feed roller (supply roller) 36 that feeds the paper sheets P in the stacking unit 12 one at a time from the uppermost one of the paper sheets P, and a suction unit 40 disposed on the inner side of the feed roller 36 in the apparatus width direction (left side of the feed roller 36 in the direction of arrow X). The suction unit 40 holds the uppermost one of the paper sheets P by suction. The transport unit 16 also includes a pair of transport rollers 38 that transport the paper sheets P fed by the feed roller 36.

For example, in the transport unit 16, the paper sheet P held by suction by the suction unit 40 comes into contact with the feed roller 36, so that the paper sheet P is fed by the feed roller 36 in the direction of arrow A and transported by the transport rollers 38 in the direction of arrow A.

Camera

The cameras 18 are examples of an imaging unit, and each camera 18 captures an image of edge portions of the paper sheets P or the small paper sheets SP that are raised and separated from each other. As illustrated in FIGS. 2 and 3, the cameras 18 are provided adjacent to side portions of the paper sheets P in the width direction (direction of arrow Z). The cameras 18 capture the images of the paper sheets P to detect the conditions of the paper sheets P that are raised and separated from each other from the outside of the paper sheets Pin the width direction.

For example, the cameras 18 are disposed on upper portions of the side guides 20 at locations near the downstream ends of the side guides 20 in a feeding direction in which the paper sheets P are fed (direction of arrow A).

As illustrated in FIG. 3, when the cameras 18 are at normal positions P1, the cameras 18 face the side portions of the paper sheets P on the plate-shaped body 12A in the width direction (direction of arrow Z). When the cameras 18 are at the normal positions P1, the edge portions of the paper sheets P on the plate-shaped body 12A in the width direction are positioned within detection areas 19 of the cameras 18. Accordingly, the cameras 18 disposed at the normal positions P1 are capable of detecting the edge portions of the normal size paper sheets P in the width direction. Thus, the normal positions P1 are examples of areas in which the paper sheets P are detectable by the cameras 18.

As illustrated in FIG. 4, the cameras 18 are movable by the moving devices 50 to displaced positions P2 that are on the inner sides of the normal positions P1 in the apparatus depth direction (direction of arrow Z). When the cameras 18 are at the displaced positions P2, the cameras 18 face the side portions of the small paper sheets SP on the plate-shaped body 12A in the width direction (direction of arrow Z). When the cameras 18 are at the displaced positions P2, the edge portions of the small paper sheets SP on the plate-shaped body 12A in the width direction are positioned within the detection areas 19 of the cameras 18. Accordingly, the cameras 18 disposed at the displaced positions P2 are capable of detecting the edge portions of the small paper sheets SP in the width direction. Thus, the displaced positions P2 are examples of areas in which the small paper sheets SP are detectable by the cameras 18.

Figure 5:
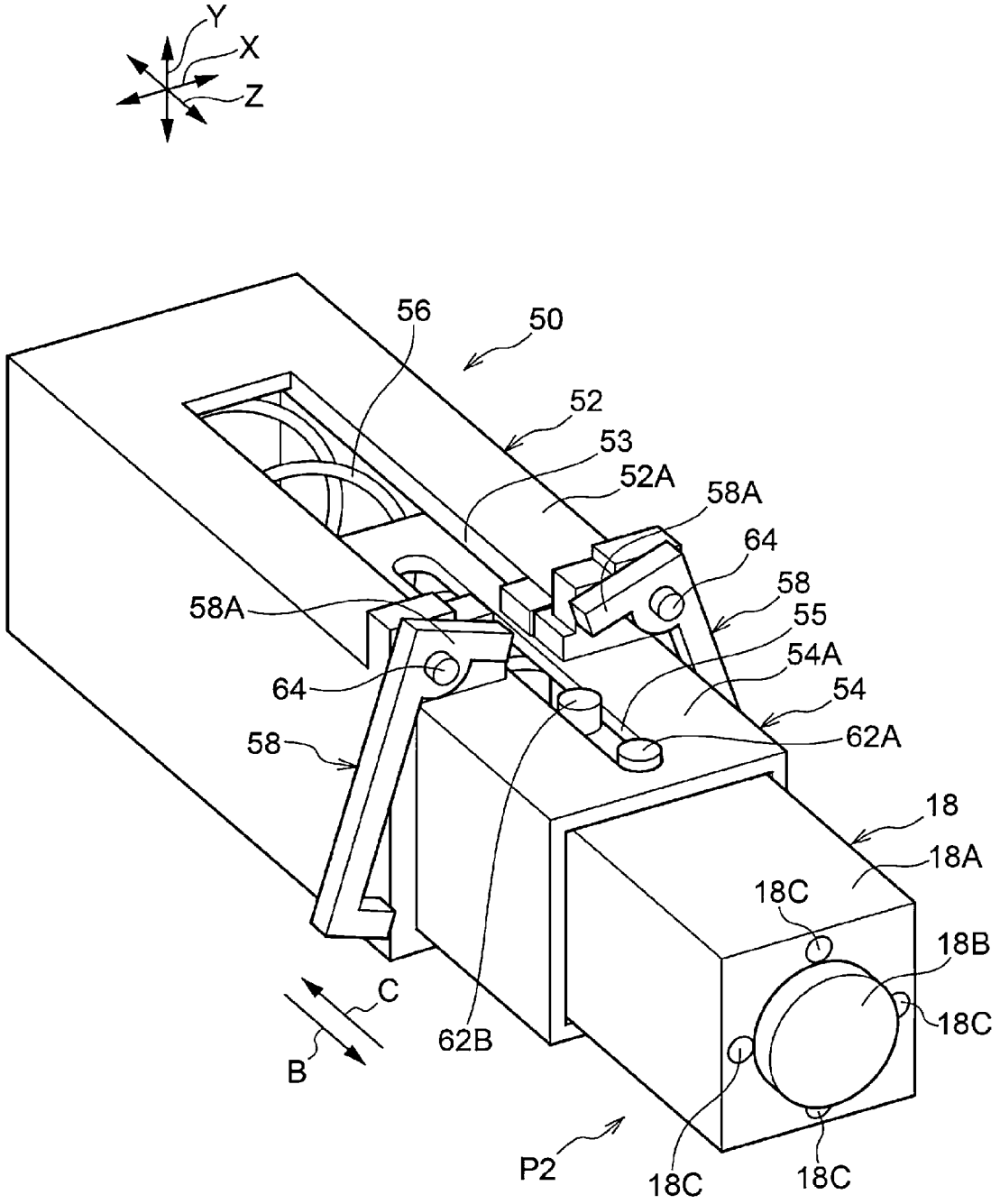
FIG. 5 is a perspective view of a camera moving device included in the medium supply device according to the first exemplary embodiment.

As illustrated in FIG. 5, each camera 18 includes a rectangular-parallelepiped-shaped casing 18A and a circular lens unit 18B disposed at a front end (end adjacent to the plate-shaped body 12A) of the casing 18A. The camera 18 also includes plural illumination units 18C arranged around the lens unit 18B. Although four illumination units 18C are illustrated as an example, the number of illumination units 18C may be changed.

Side Guides

As illustrated in FIG. 3, the side guides 20 are provided on an upper section of the stacking unit 12. The side guides 20 are provided on both sides of the paper sheets Pin the width direction (direction of arrow Z). For example, the side guides 20 are attached to the stacking unit 12 such that the side guides 20 are slidable in the apparatus depth direction (direction of arrow Z). More specifically, the side guides 20 are slidable in the apparatus depth direction (direction of arrow Z) in accordance with the size of the paper sheets P. Movable areas of the side guides 20 are limited by stoppers that are not illustrated (for example, by the lengths of guide slits) so that the side guides 20 do not interfere with the transport unit 16. Although not illustrated, each side guide 20 is provided with the air outlet 30 and the duct 32 of the supply unit 14.

Figure 6:
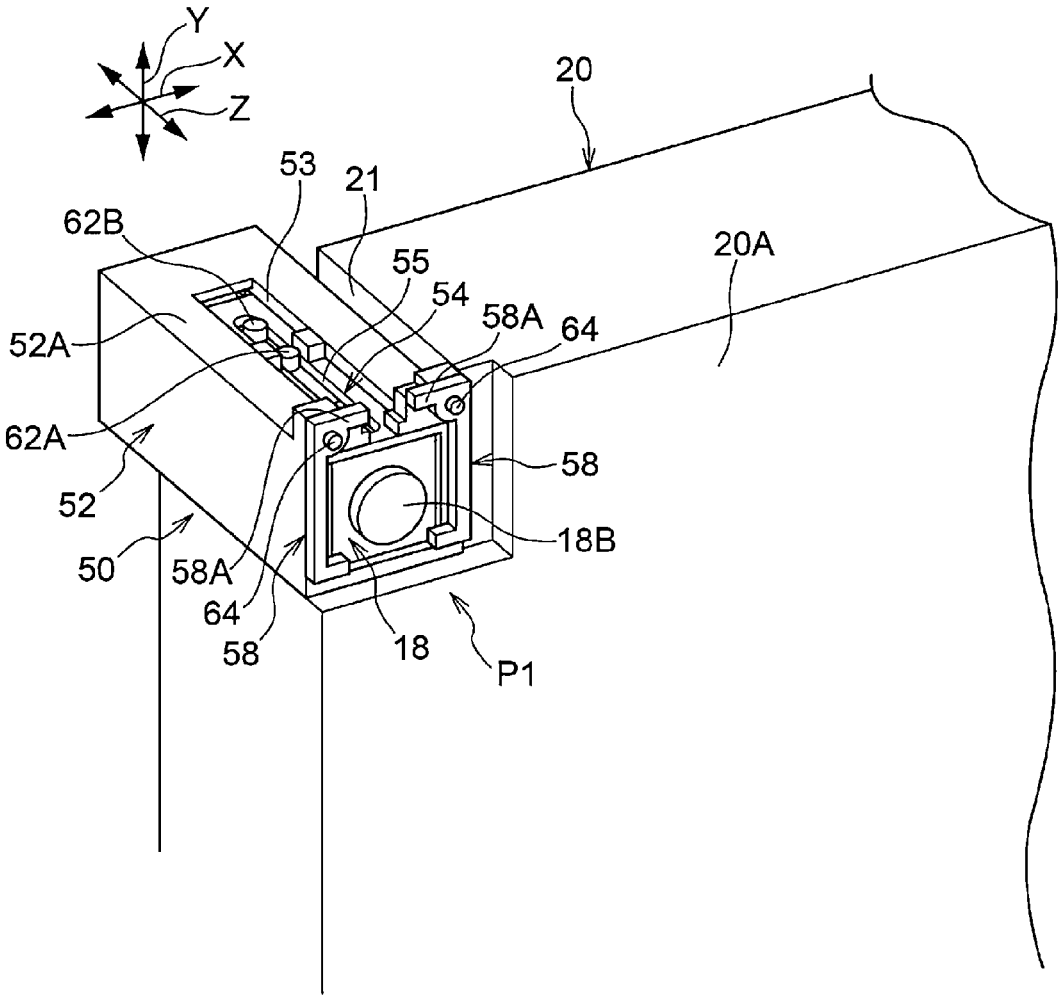
FIG. 6 is a perspective view of the side guide and the camera moving device included in the medium supply device according to the first exemplary embodiment.

As illustrated in FIGS. 3 and 6, each side guide 20 includes a vertical wall 20A extending in the vertical direction on the inner side of the side guide 20 in the apparatus depth direction (direction of arrow Z). The vertical wall 20A regulates the positions of the side portions of the paper sheets P on the plate-shaped body 12A of the stacking unit 12 in the width direction. The side guide 20 has an indented portion 21 in an upper section thereof, and a housing 52 of the moving device 50 that moves the corresponding camera 18 is attached to the indented portion 21 (see FIG. 6). In FIG. 6, the air outlet 30 and the duct 32 are omitted for simplicity.

Small-Paper-Sheet Guides

As illustrated in FIG. 4, the small-paper-sheet guides 24 regulate the positions of side portions of the small paper sheets SP on the plate-shaped body 12A of the stacking unit 12 in the width direction (direction of arrow Z). The small-paper-sheet guides 24 are provided on both sides of the small paper sheets SP in the width direction (direction of arrow Z). For example, the small-paper-sheet guides 24 are removably attached to the side guides 20 from above the side guides 20.

Figure 8:
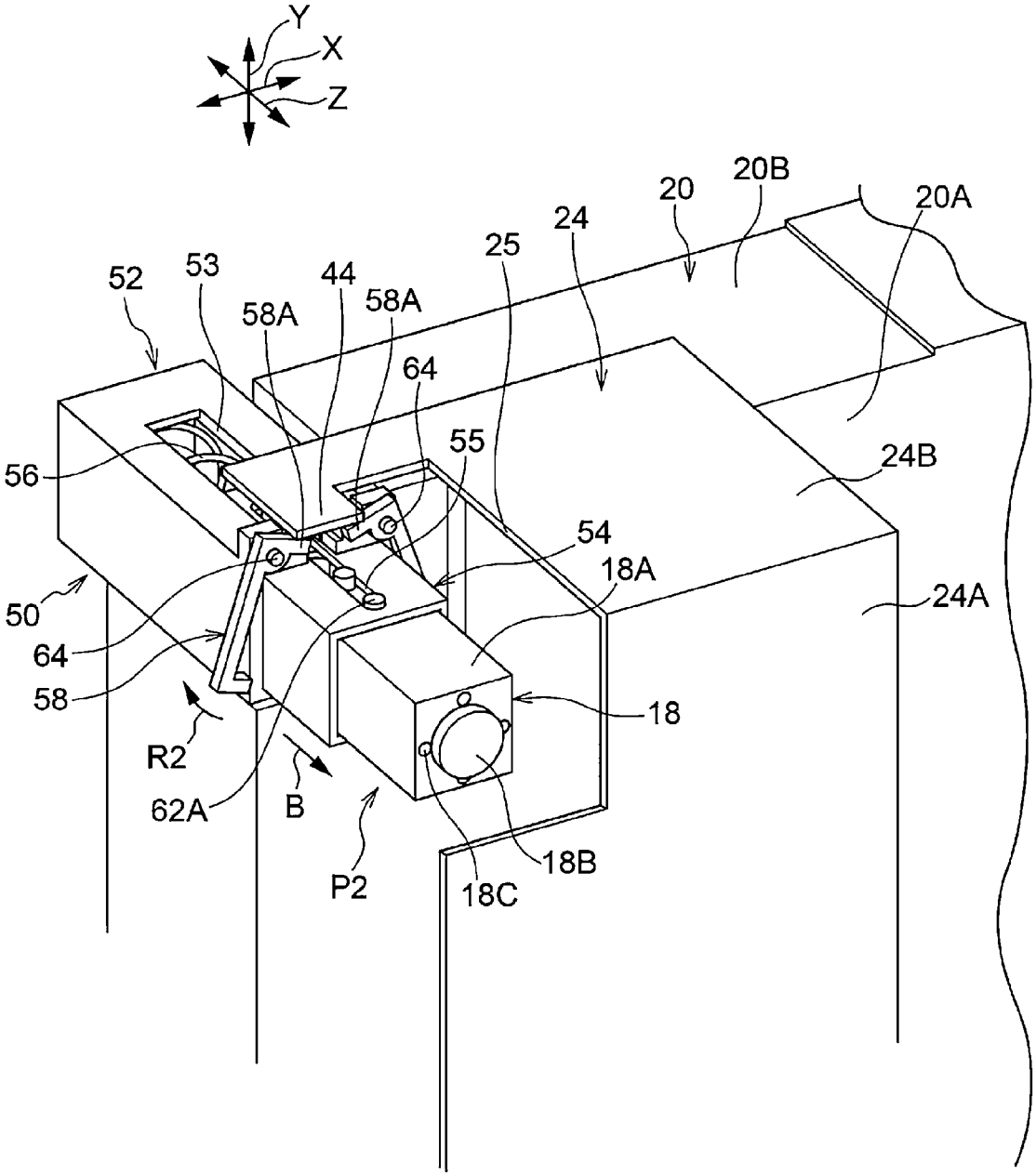
FIG. 8 is a perspective view illustrating the manner in which the camera is moved to a displaced position upon attachment of the small-paper-sheet guide to the side guide in the medium supply device according to the first exemplary embodiment.

As illustrated in FIG. 8, each small-paper-sheet guide 24 is constituted by a plate member, and includes a vertical wall 24A extending in the vertical direction on the inner side of the small-paper-sheet guide 24 in the apparatus depth direction (direction of arrow Z) and an upper wall 24B extending outward in the apparatus depth direction (direction of arrow Z) from an upper end of the vertical wall 24A. The small-paper-sheet guide 24 has a cut portion 25 that is formed in the vertical wall 24A and the upper wall 24B and at which the camera 18 is exposed when the camera 18 is moved to the displaced position P2. The cut portion 25 is shaped such that the vertical wall 24A of the small-paper-sheet guide 24 does not interfere with the region in front of the lens unit 18B and the illumination units 18C of the camera 18. Since the small-paper-sheet guide 24 has the cut portion 25, detection of the small paper sheets SP by the camera 18 is not impeded when the camera 18 is moved to the displaced positions P2. The small-paper-sheet guide 24 also has a plate-shaped projection 44 that projects inward into the cut portion 25 from the upper wall 24B in the apparatus depth direction (direction of arrow Z) at a position such that the plate-shaped projection 44 faces the housing 52 of the moving device 50. The projection 44 is an example of a contact portion. The function of the projection 44 will be described below.

When the small-paper-sheet guide 24 is attached to the side guide 20, the small-paper-sheet guide 24 is disposed such that the upper wall 24B thereof is in contact with the upper wall 20A of the side guide 20. Although not illustrated in FIG. 8 for simplicity, the small-paper-sheet guide 24 has an opening that allows passage of air from the air outlet 30 at a position such that the opening faces the air outlet 30. The side guide 20 may have a step portion to which the small-paper-sheet guide 24 is fitted to facilitate recognition of the attachment position at which the small-paper-sheet guide 24 is to be attached to the side guide 20.

Moving Devices

Each moving device 50 has a function of moving the corresponding camera 18 to the displaced position P2 in the area in which the small paper sheets SP are detectable when each small-paper-sheet guide 24 is attached to the corresponding side guide 20.

As illustrated in FIGS. 5 and 6, each moving device 50 includes a rectangular-parallelepiped-shaped housing 52 and a retainer 54 disposed in the housing 52. The moving device 50 also includes a spring 56 as an example of an urging member that urges the camera 18 inward toward the displaced position P2 in the apparatus depth direction (direction of arrow Z) in the housing 52. The moving device 50 also includes stoppers 58 that retain the camera 18 at the normal position P1 against the urging force applied by the spring 56. The spring 56 is an example of a power unit.

The housing 52 includes a wall portion 52A (upper wall in the first exemplary embodiment) having a slit 53 that extends in a direction in which the camera 18 is moved (that is, in the apparatus depth direction (direction of arrow Z)). The retainer 54 is a rectangular tube that is slidable in the apparatus depth direction in the housing 52. The retainer 54 includes a wall portion 54A that faces the slit 53, and an elongated hole 55 is formed in the wall portion 54A. The elongated hole 55 has, for example, an elongated circular shape. The elongated hole 55 extends in the apparatus depth direction.

Figure 10:
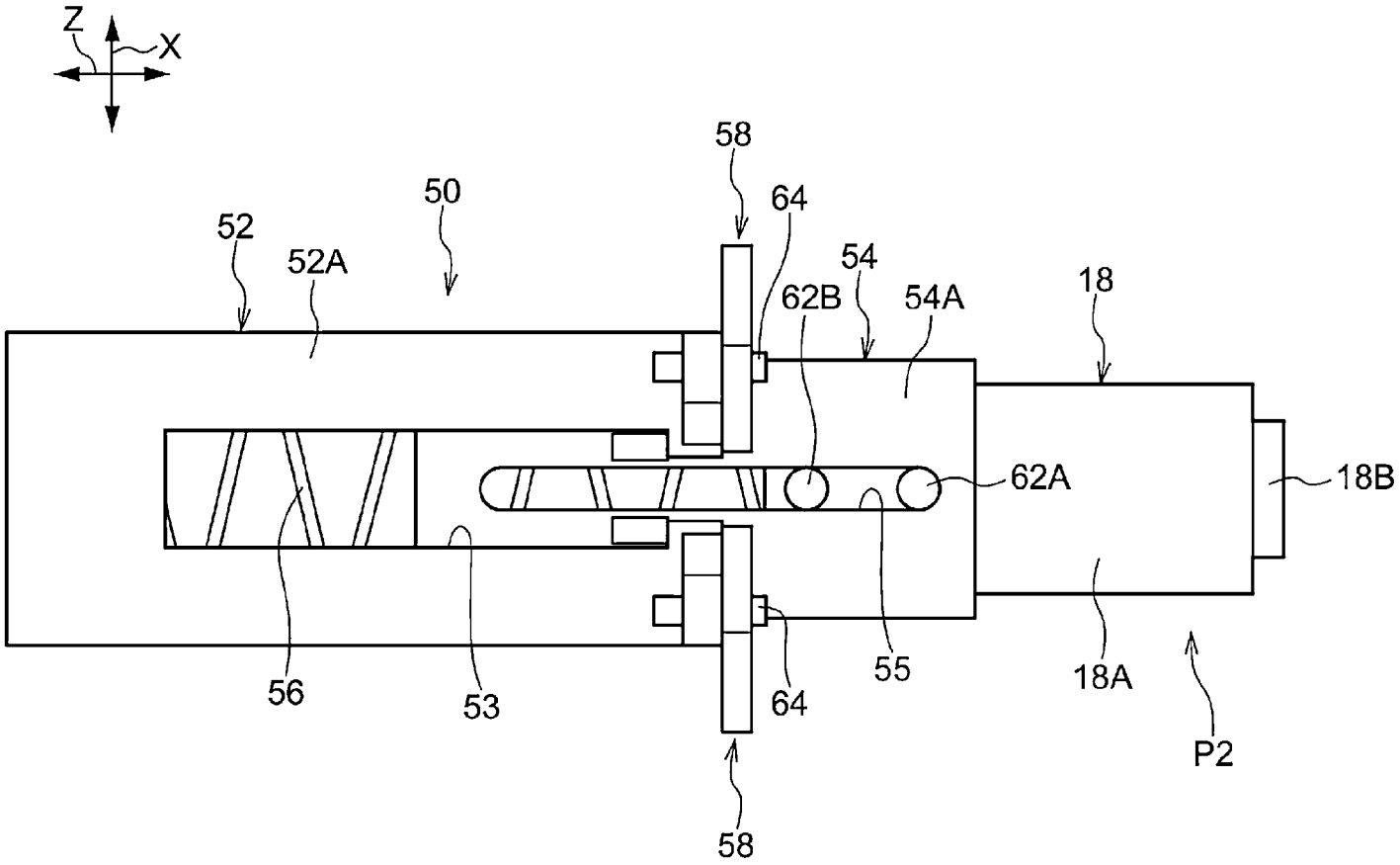
FIG. 10 is a plan view illustrating the manner in which the camera is moved to the displaced position by the camera moving device of the medium supply device according to the first exemplary embodiment.

The spring 56 is disposed between the housing 52 and the camera 18 (see FIGS. 5 and 10). The spring 56 moves the camera 18 inward in the apparatus depth direction (direction of arrow Z) to a position at which the camera 18 faces the side portions of the small paper sheets SP.

Figure 7:
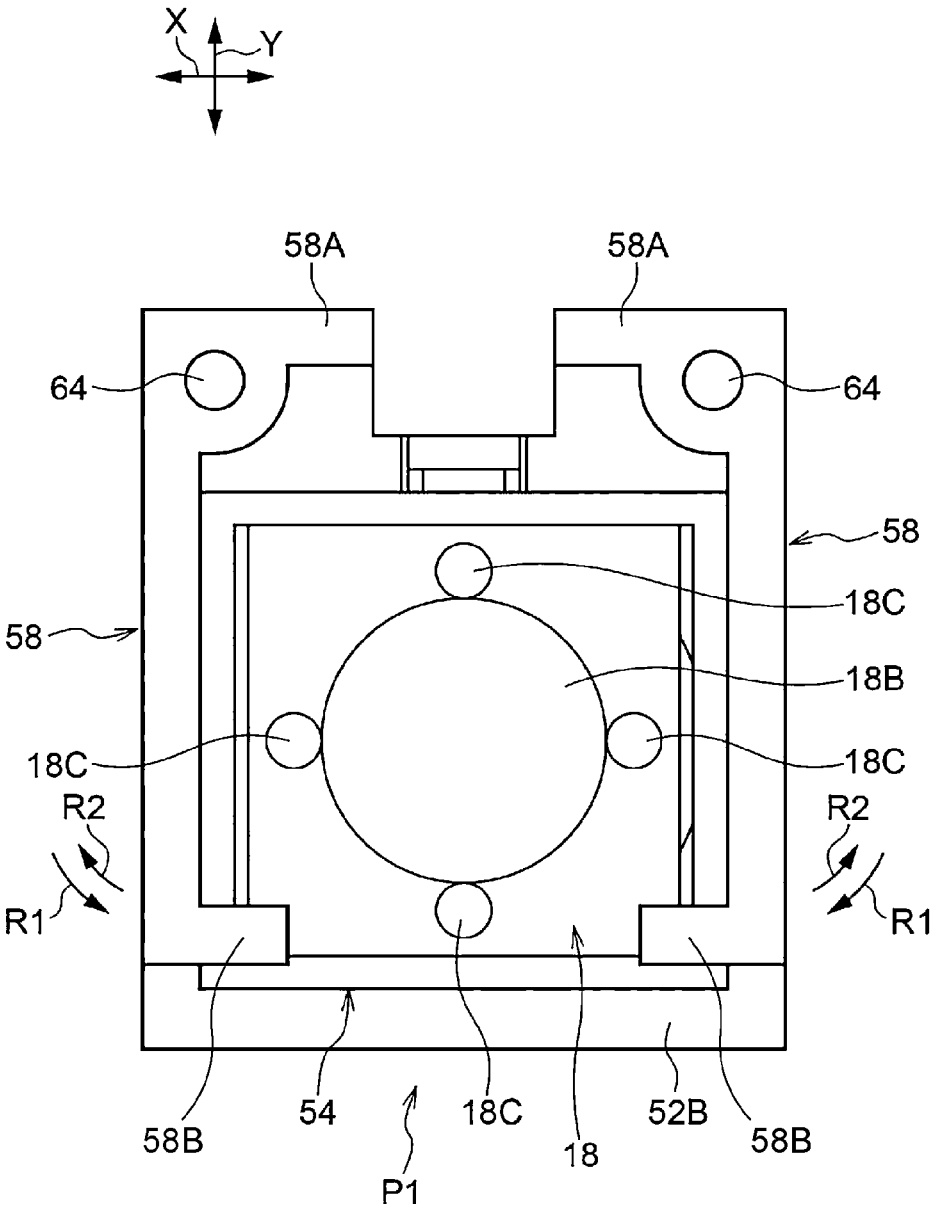
FIG. 7 is a front view of the camera moving device of the medium supply device according to the first exemplary embodiment when a camera is at a normal position.

Projections 62A and 62B inserted in the elongated hole 55 in the retainer 54 are provided at the top of the casing 18A of the camera 18. Since the projections 62A and 62B on the camera 18 are inserted in the elongated hole 55 in the retainer 54, the range of movement of the camera 18 is limited by the elongated hole 55. When the camera 18 is moved inward in the apparatus depth direction (direction of arrow Z) by the urging force of the spring 56, the projection 62A comes into contact with an edge portion of the elongated hole 55 in the retainer 54 so that the camera 18 is retained at the displaced position P2 (see FIGS. 5 and 10). Referring to FIG. 7, which is a view from the inside in the apparatus depth direction (direction of arrow Z), the stoppers 58 are U-shaped plate members disposed to extend along the edge portions of the rectangular camera 18. In the first exemplary embodiment, the stoppers 58 are provided on both sides of the camera 18 in the apparatus depth direction. The two stoppers 58 are vertically symmetrical to each other with respect to the camera 18.

The housing 52 includes shafts 64 on an upper portion of an inner end surface 52B in the apparatus depth direction (direction of arrow Z), and upper portions 58A of the stoppers 58 are rotatable about the respective shafts 64 (see FIG. 7). In a normal state (free state), the stoppers 58 are rotated in closing directions thereof shown by arrows R1 due to their own weight, and are in contact with portions of the camera 18 (see FIG. 7). In the first exemplary embodiment, lower portions 58B of the stoppers 58 are in contact with an end surface of the casing 18A of the camera 18 on which the lens unit 18B is provided. Thus, the camera 18 is engaged with the stoppers 58, and is thereby retained at the normal position P1 against the urging force of the spring 56.

Figure 9:
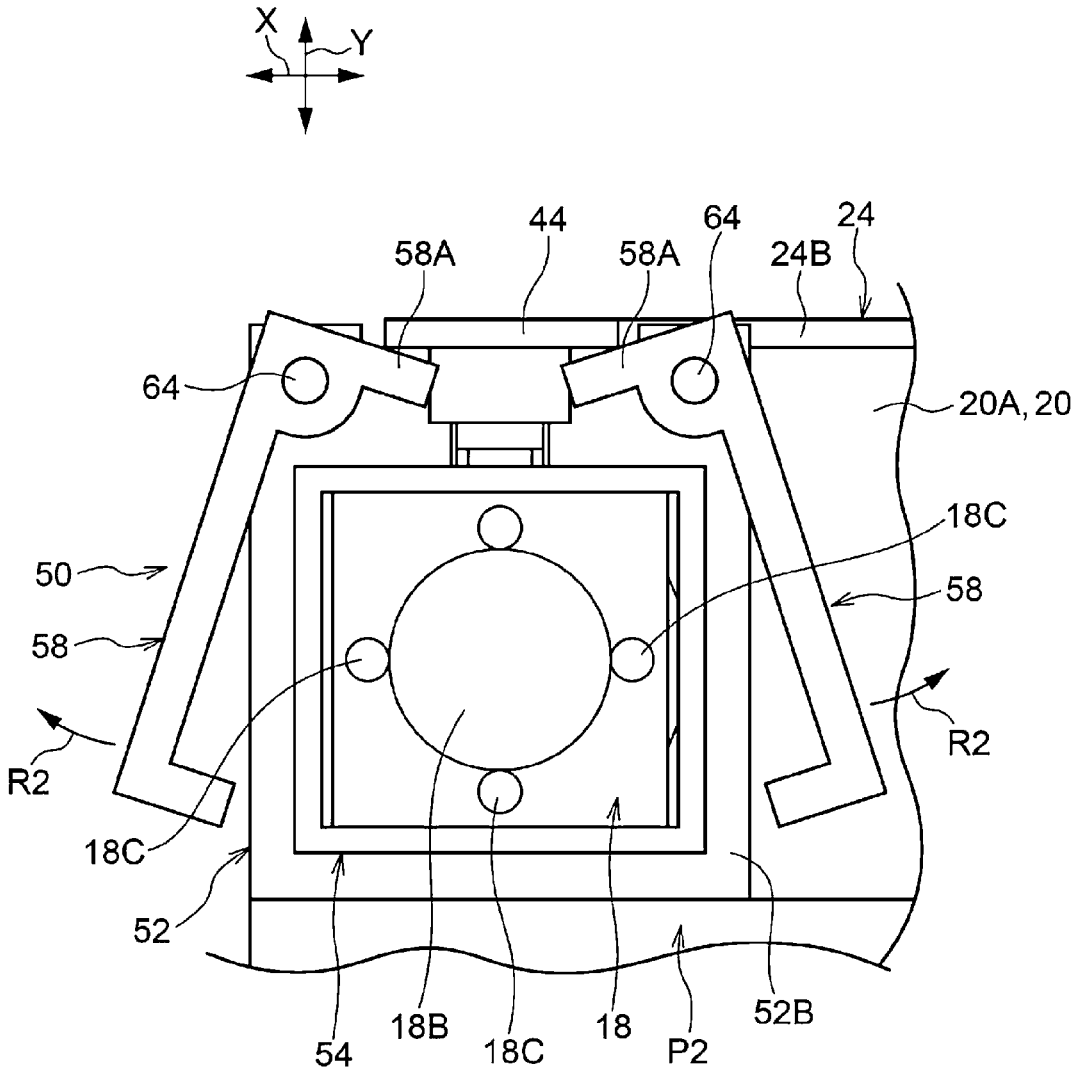
FIG. 9 is a front view illustrating the manner in which the camera is moved to the displaced position by the camera moving device of the medium supply device according to the first exemplary embodiment.

Referring to FIG. 8, the medium supply device 10 is configured such that the spring 56 operates in response to the attachment of the small-paper-sheet guide 24 and moves the camera 18 to the displaced position P2 at which the camera 18 faces the side portions of the small paper sheets SP in the width direction (direction of arrow Z). More specifically, when the small-paper-sheet guide 24 is attached to the side guide 20, the projection 44 of the small-paper-sheet guide 24 comes into contact with the upper portions 58A of the stoppers 58 and pushes the upper portions 58A downward, so that the stoppers 58 rotate in opening directions thereof shown by arrows R2 (see FIG. 9). Thus, the camera 18 that has been engaged with (retained by) the stoppers 58 is released, and is moved by the urging force of the spring 56 as shown by arrow B to the displaced position P2 at which the camera 18 faces the side portions of the small paper sheets SP in the width direction.

In the first exemplary embodiment, when the camera 18 is released from the stoppers 58, the camera 18 and the retainer 54 are moved inward in the apparatus depth direction (direction of arrow Z) by the urging force of the spring 56. The camera 18 is moved to the displaced position P2 at which the projection 62A comes into contact with an edge portion of the elongated hole 55 in the retainer 54. Since the moving device 50 includes the retainer 54, the overall size of the moving devices 50 may be reduced and the moving distance of the camera 18 may be increased compared to those in the case where the camera 18 is disposed directly in the casing.

In addition, in the medium supply device 10, when the small-paper-sheet guide 24 is removed, the user performs an operation of moving the camera 18 to the normal position P1. More specifically, the user moves the camera 18 against the urging force of the spring 56 to a position beyond the stoppers 58 in the direction of arrow C (see FIG. 5). At this time, the retainer 54 moves outward in the apparatus depth direction (direction of arrow Z) by being pushed by, for example, the projection 62B on the camera 18. When the camera 18 is moved to a position beyond the stoppers 58 in the direction of arrow C (see FIG. 5), the stoppers 58 are rotated in the directions of arrows R1 due to their own weight, and the camera 18 is engaged with the stoppers 58, so that the camera 18 is retained at the normal position P1 (see, for example, FIG. 7).

Figure 11A:
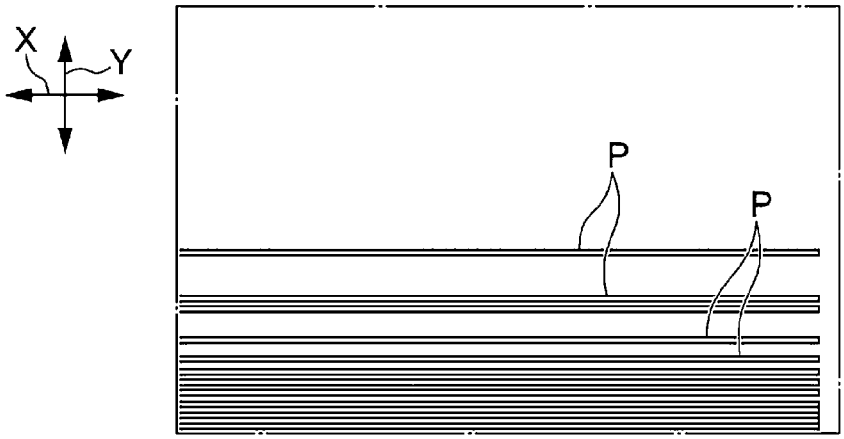
FIG. 11A illustrates an example in which paper sheets are appropriately raised and separated from each other.
Figure 11B:
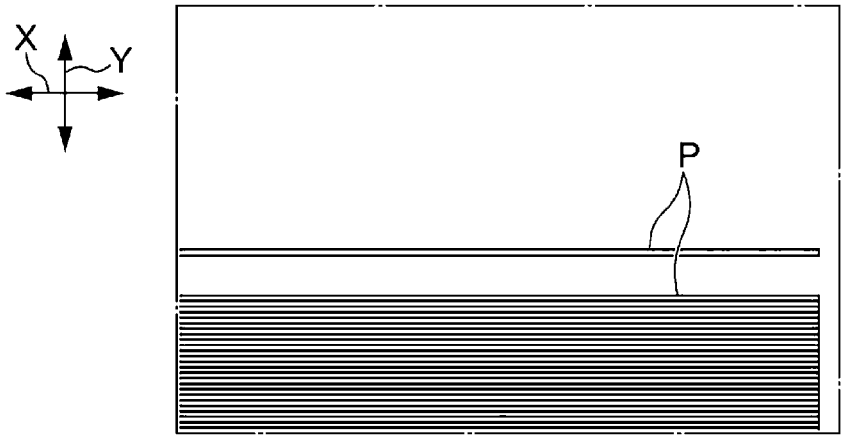
FIG. 11B illustrates an example in which the paper sheets are not appropriately raised and separated from each other.
Figure 11C:
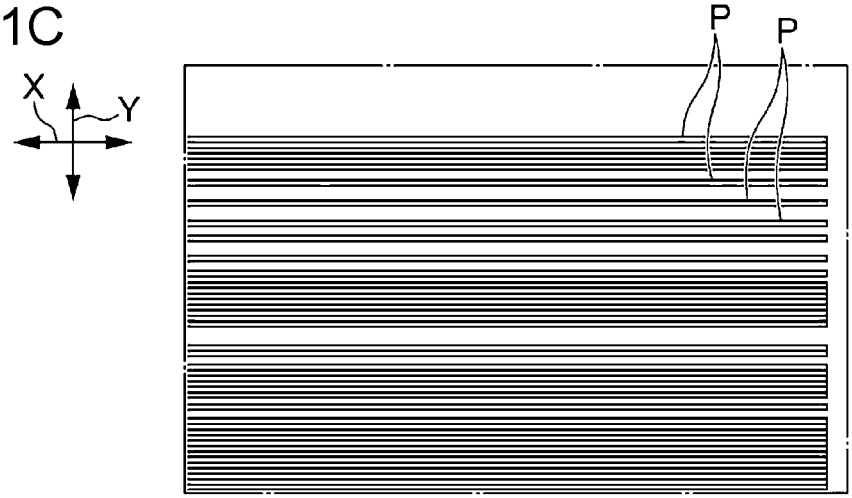
FIG. 11C illustrates another example in which the paper sheets are not appropriately raised and separated from each other.

FIGS. 11A to 11C schematically illustrate examples of the conditions of the paper sheets P detected by the camera 18 when air is blown from the air outlet 30 of the supply unit 14 against the paper sheets P stacked on the plate-shaped body 12A of the stacking unit 12. In a first example illustrated in FIG. 11A, about ten paper sheets P at the top are raised and separated from each other, and the conditions of the paper sheets P that are raised and separated from each other are appropriate. In this state, double feeding of the paper sheets P, for example, does not easily occur when the paper sheets P are successively transported by the transport unit 16.

In a second example illustrated in FIG. 11B, only one paper sheet P is raised, and the paper sheets P are not sufficiently raised and separated from each other. In this state, when the paper sheets P are successively transported by the transport unit 16, there is a possibility that a supply failure in which the paper sheets P cannot be smoothly supplied (that is, misfeed) will occur.

In a third example illustrated in FIG. 11C, air is blown out from the air outlet 30 too strongly such that the paper sheets P at the top are raised in groups, and thus the paper sheets P are not appropriately raised and separated from each other. In this state, when the paper sheets P are successively transported by the transport unit 16, there is a possibility that double feeding of the paper sheets P will occur.

The controller 70 changes the amount of air supplied by controlling the rotation of the fan 34 of the supply unit 14 based on the conditions of the paper sheets P detected by the camera 18. Thus, the conditions of the paper sheets P that are raised and separated from each other are adjusted.

Operations

Operations of the present exemplary embodiment will now be described.

In the medium supply device 10, the side guides 20 regulate the positions of the edge portions of the normal size paper sheets P on the plate-shaped body 12A of the stacking unit 12 in the width direction (direction of arrow Z) of the paper sheets P. In this state, air is blown from the air outlet 30 of the supply unit 14 so that the paper sheets P stacked on the plate-shaped body 12A of the stacking unit 12 are raised and separated from each other.

Each camera 18 is retained at the normal position P1 by being engaged with the stoppers 58 of the corresponding moving device 50 (see FIG. 6). In this state, edge portions of the normal size paper sheets P on the plate-shaped body 12A of the stacking unit 12 in the width direction (direction of arrow Z) are positioned within the detection areas 19 of the cameras 18 (see FIG. 3). Accordingly, the cameras 18 are capable of detecting the conditions of the paper sheets P on the plate-shaped body 12A of the stacking unit 12 that are raised and separated from each other from the outside of the paper sheets P in the width direction.

When the small paper sheets SP, which have a smaller dimension than the normal size paper sheets P in the width direction, are used, each small-paper-sheet guide 24 is attached to the corresponding side guide 20 (see FIG. 8). When the small-paper-sheet guide 24 is attached to the side guide 20, the projection 44 of the small-paper-sheet guide 24 comes into contact with the upper portions 58A of the stoppers 58 and pushes the upper portions 58A downward. Accordingly, each stopper 58 rotates in the opening direction thereof shown by the arrow R2, and the camera 18 retained by the stoppers 58 is released. Thus, the camera 18 is moved by the urging force of the spring 56, as shown by arrow B, to the displaced position P2 at which the camera 18 faces the side portions of the small paper sheets SP in the width direction.

When each camera 18 is at the displaced position P2 thereof, edge portions of the small paper sheets SP on the plate-shaped body 12A of the stacking unit 12 in the width direction (direction of arrow Z) are positioned within the detection areas 19 of the cameras 18 (see FIG. 4). Accordingly, the cameras 18 disposed at the displaced positions P2 are capable of detecting the edge portions of the small paper sheets SP on the plate-shaped body 12A of the stacking unit 12 in the width direction.

Figure 19:
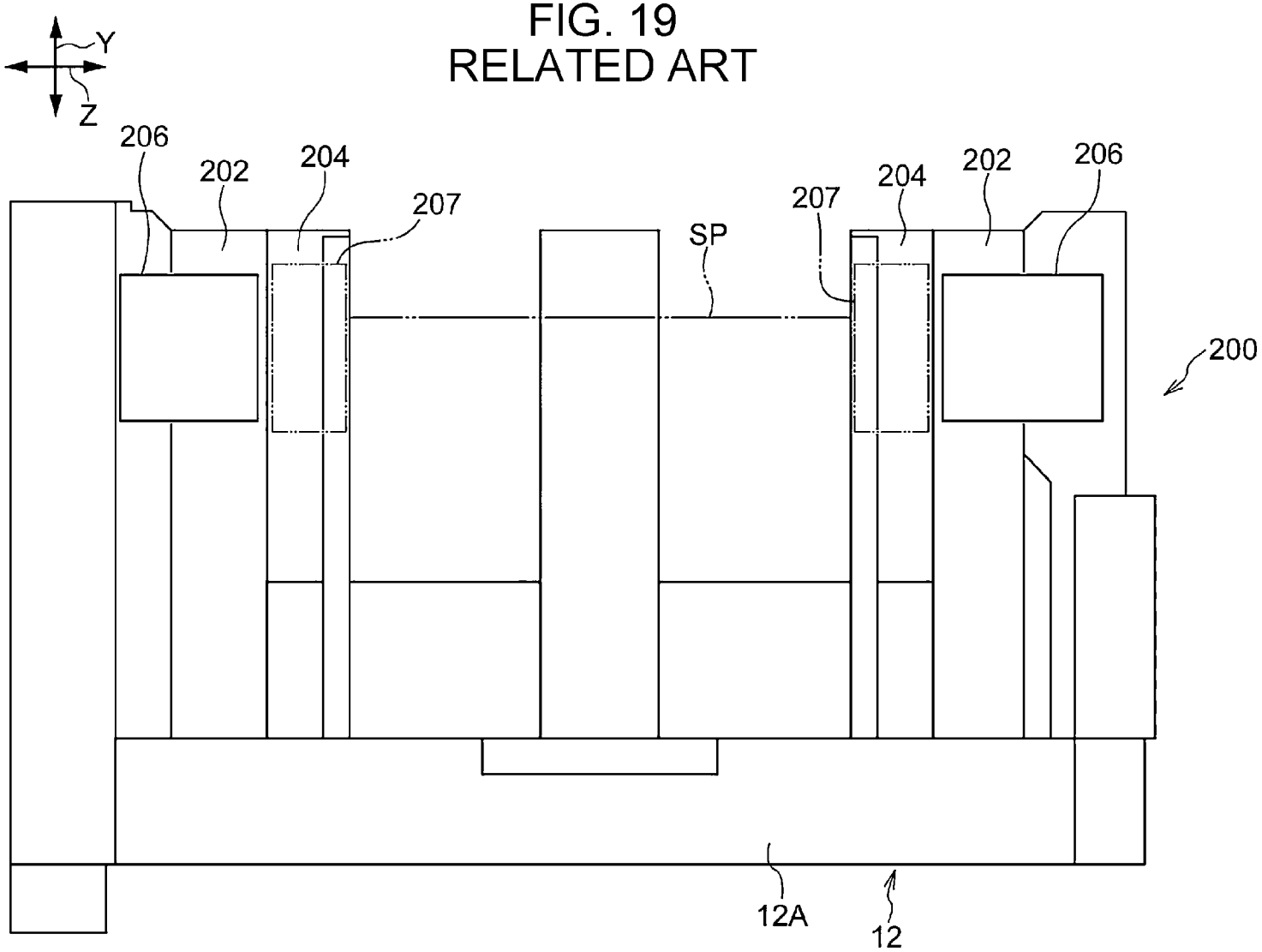
FIG. 19 RELATED ART
FIG. 19 illustrates detection areas of detection units when small-paper-sheet guides are attached to side guides in a medium supply device according to a comparative example.

A medium supply device 200 according to a comparative example will now be described with reference to FIG. 19. As illustrated in FIG. 19, in the medium supply device 200, the positions of cameras 206 do not change upon attachment of small-paper-sheet guides 204 to the side guides 202. There may be a case in which edge portions of the small paper sheets SP on the plate-shaped body 12A of the stacking unit 12 in the width direction are not positioned within detection areas 207 of the cameras 206, and therefore it is difficult to accurately detect the edge portions of the small paper sheets SP in the width direction with the cameras 206.

In contrast, in the medium supply device 10 according to the first exemplary embodiment, when the small-paper-sheet guides 24 are attached, each camera 18 retained by the stoppers 58 is released and is moved by the urging force of the spring 56 to the displaced position P2 at which the camera 18 faces the side portions of the small paper sheets SP in the width direction.

In addition, in the medium supply device 10, the cameras 18 are provided on the side guides 20, and the small-paper-sheet guides 24 are removably attachable to the side guides 20.

In addition, in the medium supply device 10, each moving device 50 includes the spring 56 that moves the corresponding camera 18 to the position at which the camera 18 faces the side portions of the small paper sheets SP. The spring 56 operates in response to the attachment of the corresponding small-paper-sheet guide 24 to move the camera 18 to the displaced position P2 at which the camera 18 faces the side portions of the small paper sheets SP.

In addition, in the medium supply device 10, each moving device 50 is configured such that the user performs an operation of moving the camera 18 to the area in which the normal size paper sheets P are detectable when the small-paper-sheet guide 24 is removed.

In addition, in the medium supply device 10, each moving device 50 includes the spring 56 that urges the camera 18 in a direction for moving the camera 18 to the area in which the small paper sheets SP are detectable, and also includes the stopper 58 that retains the camera 18 in the area in which the normal size paper sheets P are detectable against the urging force applied by the spring 56. The projection 44 provided on the small-paper-sheet guide 24 comes into contact with the stoppers 58 to release the camera 18 from the stoppers 58.

In addition, in the medium supply device 10, each small-paper-sheet guide 24 has the cut portion 25 so that detection by the camera 18 is not impeded when the camera 18 is moved to the area in which the small paper sheets SP are detectable (see FIG. 8).

In addition, in the medium supply device 10, the small-paper-sheet guides 24 are attached at both sides of the small paper sheets SP in the width direction (direction of arrow Z), and the cameras 18 are provided at both sides of the small paper sheets SP in the width direction.

In addition, the medium supply device 10 includes the controller 70 including a processor, and the controller 70 changes the amount of air supplied by the supply unit 14 based on the result of the detection performed by the cameras 18.

In addition, in the medium supply device 10, the cameras 18 capture images of the edge portions of the paper sheets P or the small paper sheets SP that are raised and separated from each other.

The image forming apparatus 100 includes the medium supply device 10 and the image forming unit 102 that forms images on the paper sheets P supplied by the medium supply device 10.

Second Exemplary Embodiment

A medium supply device according to a second exemplary embodiment will now be described. Components that are the same as those in the above-described first exemplary embodiment are denoted by the same reference numerals, and description thereof will thus be omitted.

Figure 12:
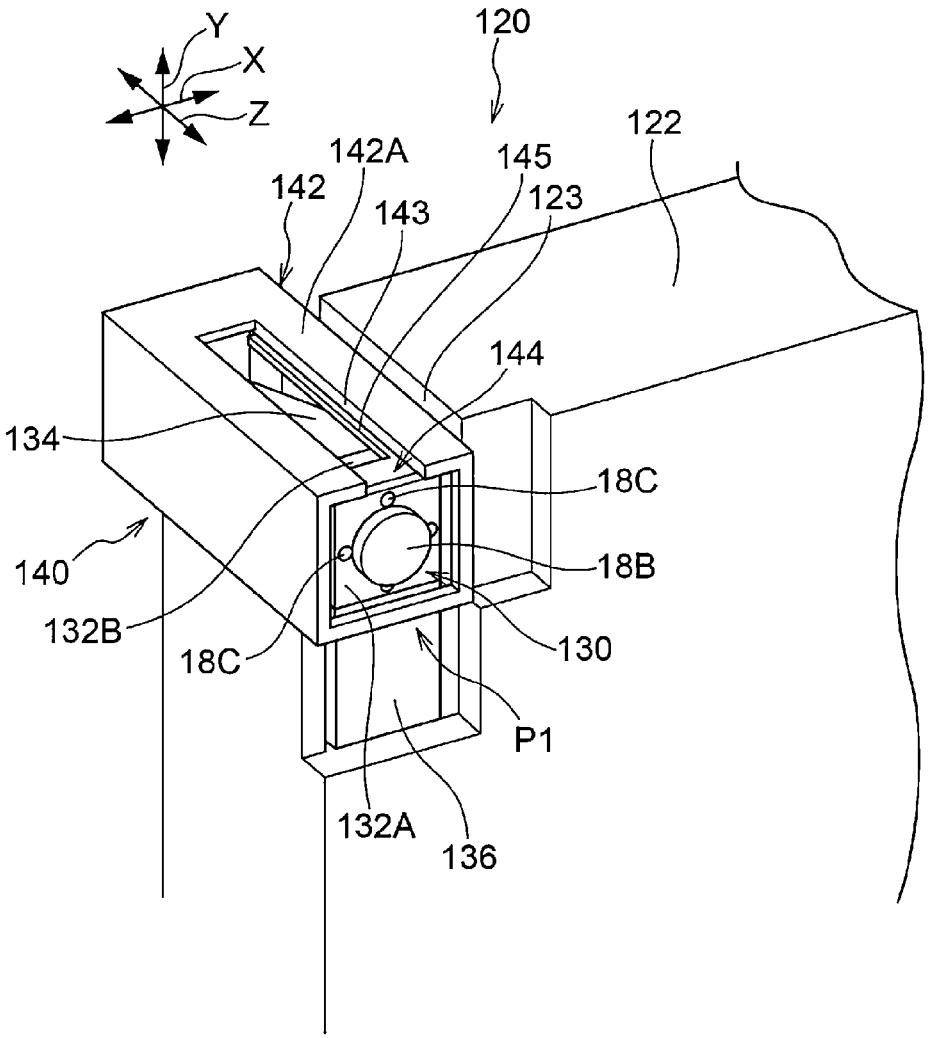
FIG. 12 is a perspective view of a side guide and a camera moving device included in a medium supply device according to a second exemplary embodiment.
Figure 13:
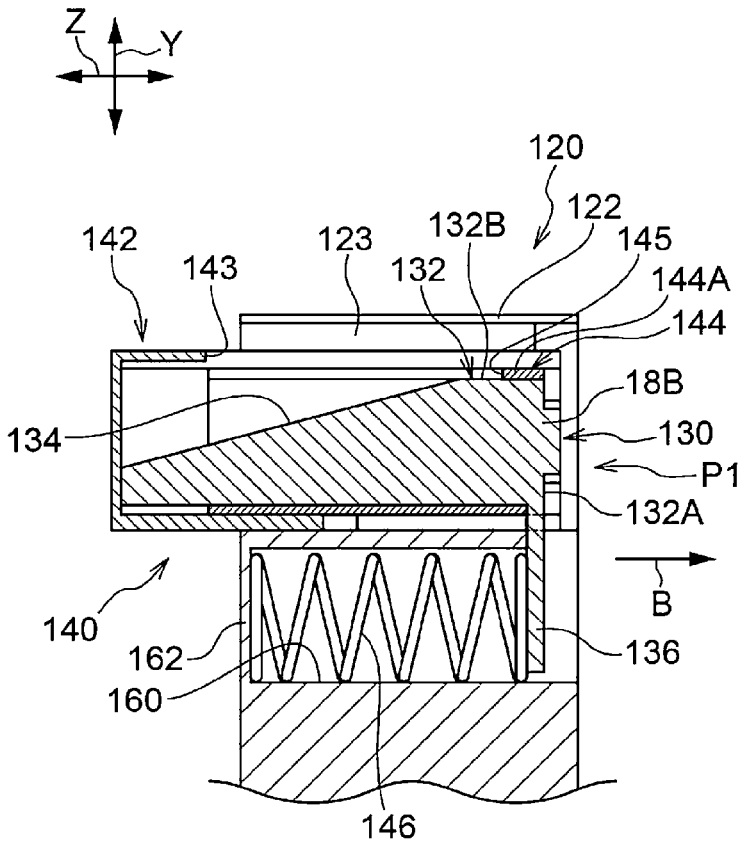
FIG. 13 is a sectional view of the camera moving device of the medium supply device according to the second exemplary embodiment when a camera is at a normal position.

Referring to FIGS. 12 and 13, a medium supply device 120 according to the second exemplary embodiment includes a side guide 122, a small-paper-sheet guide 126, a camera 130, and a moving device 140 having structures different from those in the medium supply device 10 according to the first exemplary embodiment. The side guide 122 is an example of a first regulating unit, and the small-paper-sheet guide 126 is an example of a second regulating unit. The camera 130 is an example of a detection unit and an example of an imaging unit, and the moving device 140 is an example of a moving unit.

The side guide 122 has an indented portion 123 in an upper section thereof. The moving device 140 that moves the camera 130 is disposed in the indented portion 123.

The camera 130 includes a housing 132. The housing 132 has an end surface 132A that extends in the vertical direction on the inner side of the housing 132 in the apparatus depth direction (direction of arrow Z), and an upper wall portion 132B that extends in a horizontal direction from the upper end of the end surface 132A. The housing 132 also has an inclined surface 134 inclined to extend downward and outward in the apparatus depth direction (direction of arrow Z) from the upper wall portion 132B (see FIG. 13). The inclined surface 134 is an example of a first inclined surface. The inclined surface 134 extends in a direction crossing the direction of arrow B in which the camera 130 is moved to the displaced position P2.

The camera 130 also includes an extending portion 136 that extends downward from the end surface 132A of the housing 132. The side guide 122 has a recess 160 disposed below the indented portion 123 at a position such that the recess 160 faces the extending portion 136. A vertical wall 162 at the back of the recess 160 faces the extending portion 136 of the camera 130.

The moving device 140 includes a rectangular-parallelepiped-shaped housing 142 and a retainer 144 disposed in the housing 142. The moving device 140 also includes a tension spring 146 disposed between the vertical wall 162 of the side guide 122 and the extending portion 136 of the camera 130. Although not illustrated, both ends of the tension spring 146 are hook-shaped, and are engaged with the vertical wall 162 of the side guide 122 and the extending portion 136 of the camera 130. The tension spring 146 is an example of a power unit. The tension spring 146 pulls the camera 130 to move the camera 130 to the normal position P1 in the area in which the normal size paper sheets P are detectable.

The housing 142 includes an upper wall 142A having a slit 143 that extends in a direction in which the camera 130 is moved (that is, in the apparatus depth direction (direction of arrow Z)). The retainer 144 is a rectangular tube that is slidable in the apparatus depth direction (direction of arrow Z) in the housing 142. The retainer 144 has an upper wall 144A having a slit 145 at a position corresponding to the position of the slit 143. The slit 145 extends in the apparatus depth direction.

Figure 14:
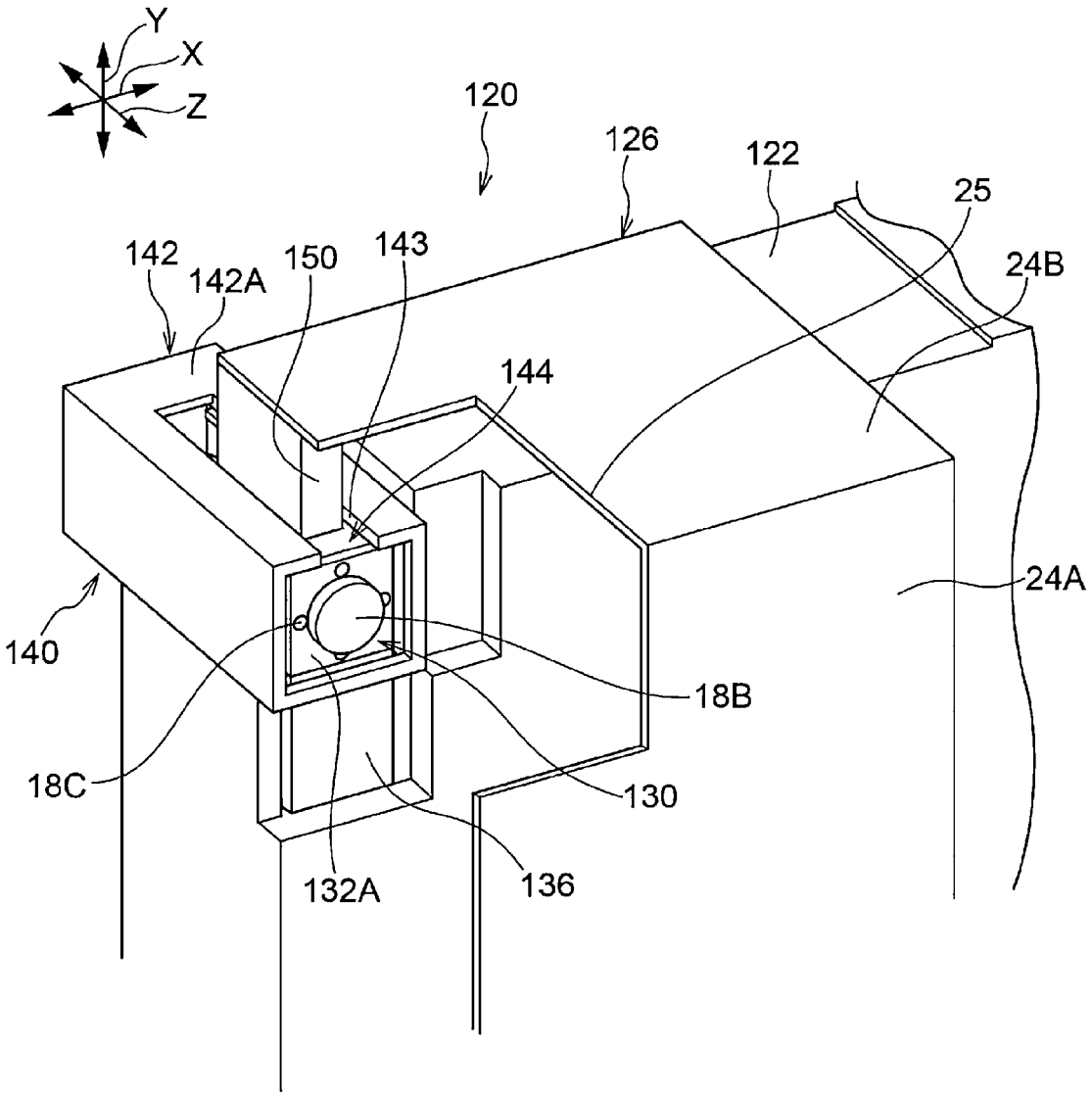
FIG. 14 is a perspective view of the camera that is being moved to a displaced position upon attachment of a small-paper-sheet guide to the side guide in the medium supply device according to the second exemplary embodiment.
Figure 15:
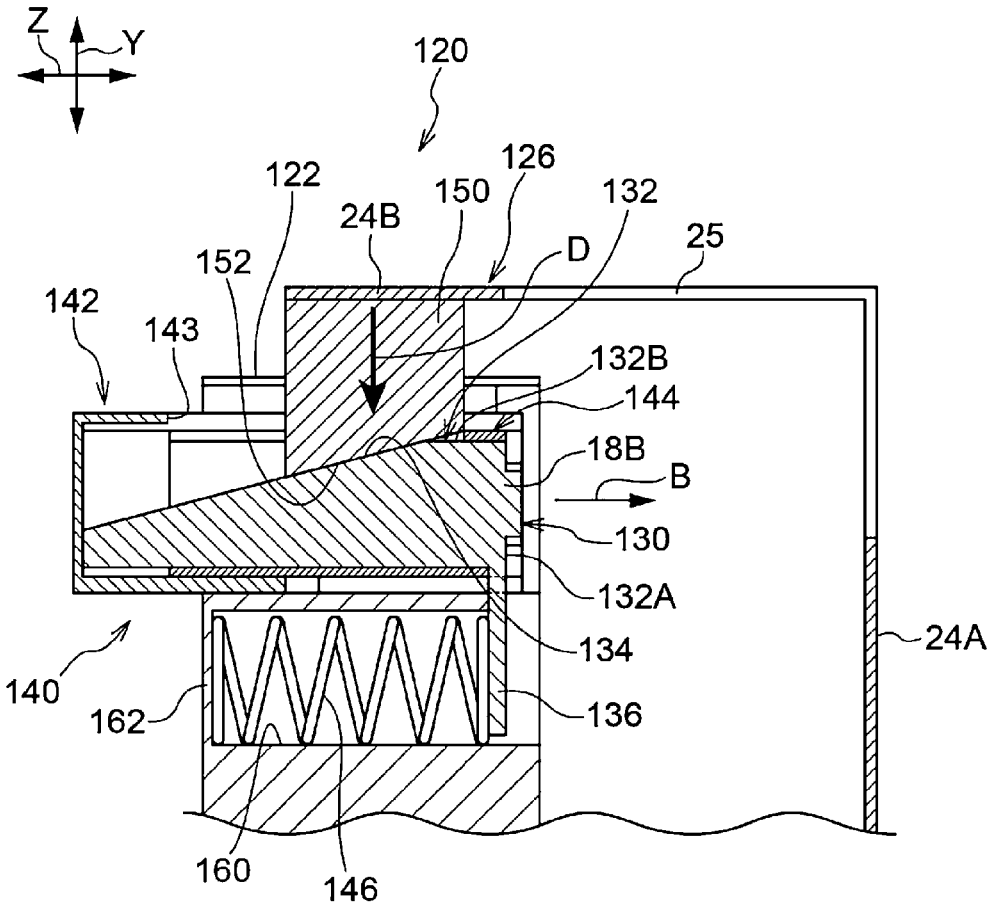
FIG. 15 is a sectional view of the camera that is being moved to the displaced position upon attachment of the small-paper-sheet guide to the side guide in the medium supply device according to the second exemplary embodiment.

As illustrated in FIGS. 14 and 15, the small-paper-sheet guide 126 is removably attached to the side guide 122 from above the side guide 122. The small-paper-sheet guide 126 includes a block portion 150 that extends downward from the upper wall 24B. When the small-paper-sheet guide 126 is attached to the side guide 122, the block portion 150 is inserted through the slit 143 in the housing 142 and the slit 145 in the retainer 144.

The block portion 150 has an inclined surface 152 that comes into contact with the inclined surface 134 of the camera 130 at the bottom of thereof (see FIG. 15). The inclined surface 152 extends along the inclined surface 134 of the camera 130. The inclined surface 152 is an example of a second inclined surface.

When the small-paper-sheet guide 126 is attached to the side guide 122, the inclined surface 152 of the block portion 150 comes into contact with the inclined surface 134 of the camera 130 (see FIG. 15). Then, when the inclined surface 152 of the block portion 150 is pushed downward in the direction of arrow D, the inclined surface 134 of the camera 130 slides along the inclined surface 152 so that the camera 130 is moved against the force of the tension spring 146 in a direction toward the displaced position P2 at which the small paper sheets SP are detectable (direction of arrow B).

Figure 16:
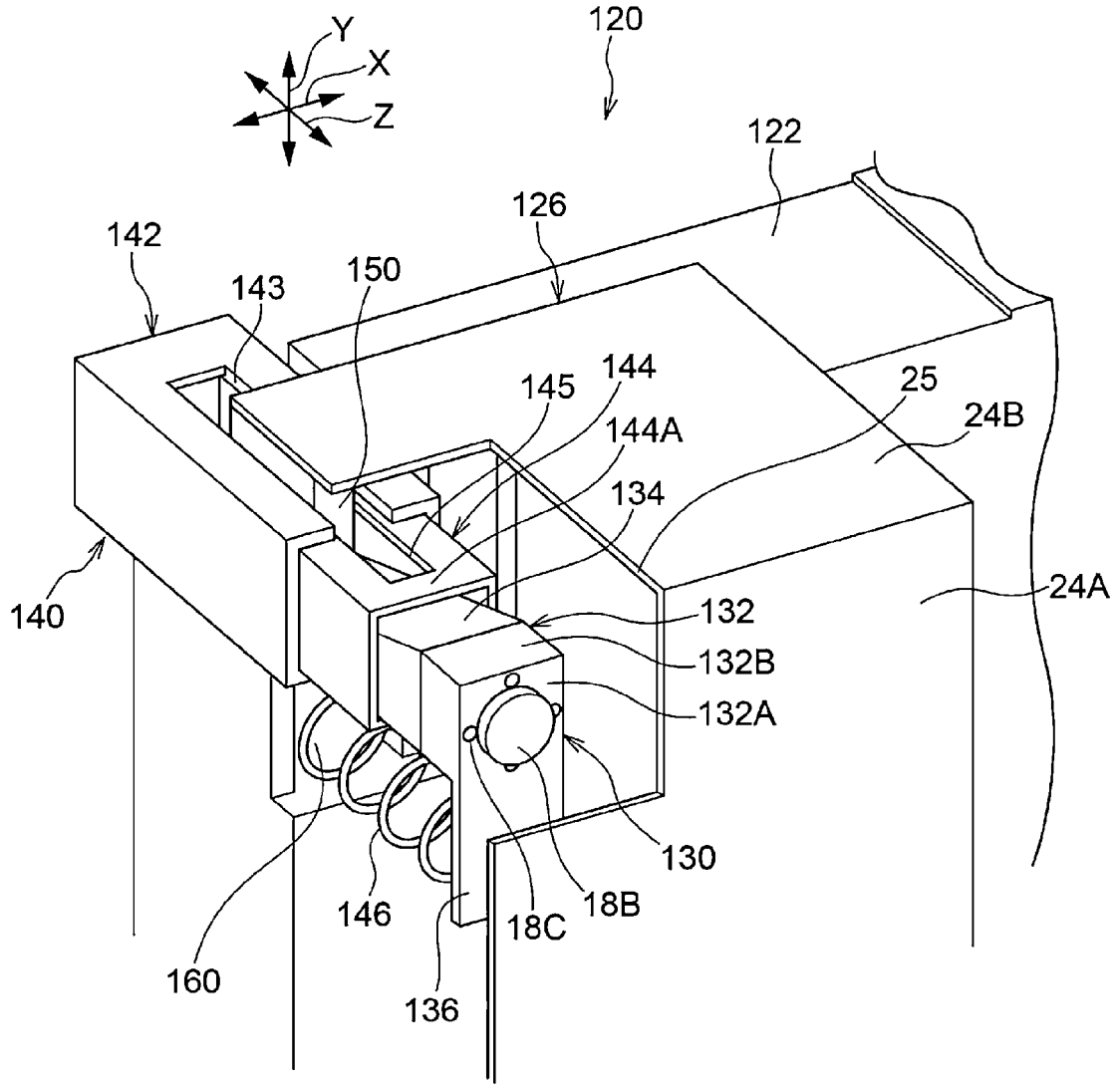
FIG. 16 is a perspective view of the camera moved to the displaced position upon attachment of the small-paper-sheet guide to the side guide in the medium supply device according to the second exemplary embodiment.
Figure 17:
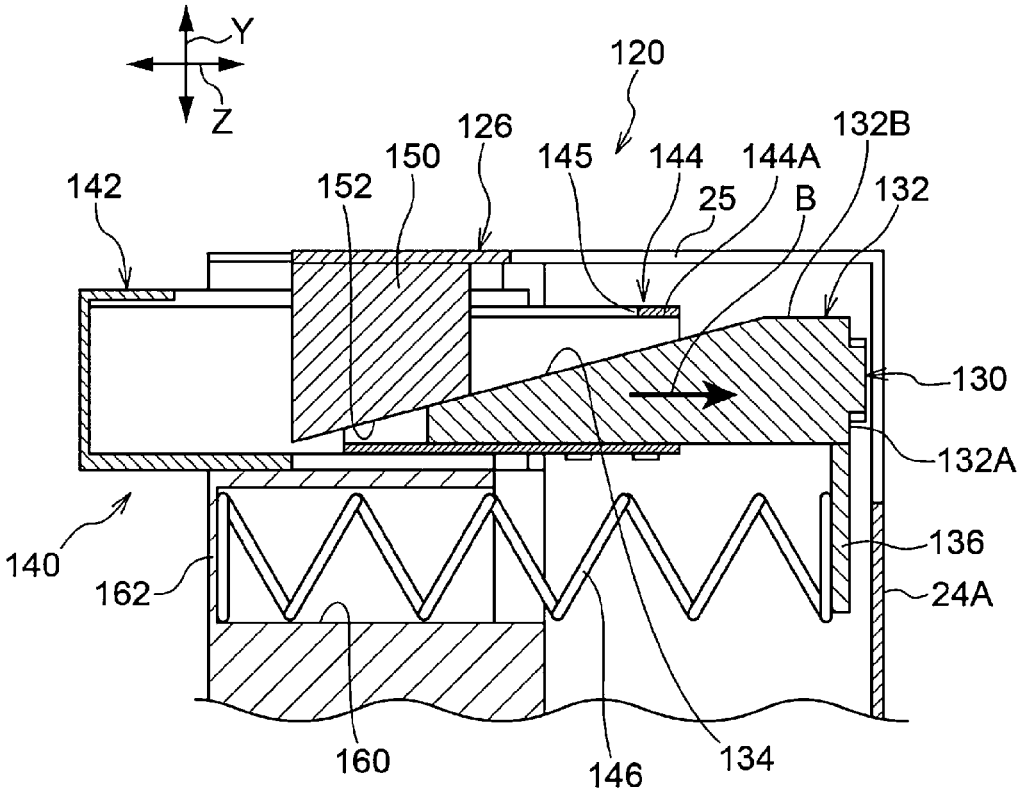
FIG. 17 is a sectional view of the camera moved to the displaced position upon attachment of the small-paper-sheet guide to the side guide in the medium supply device according to the second exemplary embodiment.

As illustrated in FIGS. 16 and 17, when the small-paper-sheet guide 126 is attached to the side guide 122, the inclined surface 152 of the block portion 150 pushes the inclined surface 134 of the camera 130 so that the camera 130 is moved to the displaced position P2.

When the small-paper-sheet guide 126 is removed from the side guide 122, the inclined surface 152 of the block portion 150 is separated from the inclined surface 134 of the camera 130. Accordingly, the camera 130 is moved by the force of the tension spring 146 to the normal position P1 at which the normal size paper sheets P are detectable (see FIG. 13).

The medium supply device 120 according to the second exemplary embodiment provides operations described below in addition to operations provided by structures similar to those in the medium supply device 10 according to the first exemplary embodiment.

In the medium supply device 120, the moving device 140 includes the tension spring 146 that moves the camera 130 to the normal position P1, the inclined surface 134 formed on the camera 130, and the inclined surface 152 formed on the block portion 150 of the small-paper-sheet guide 126. When the small-paper-sheet guide 126 is attached to the side guide 122, the inclined surface 152 comes into contact with the inclined surface 134 and pushes the camera 130 to the displaced position P2 against the force of the tension spring 146.

In the medium supply device 120, the tension spring 146 operates to move the camera 130 to the normal position P1 in the area in which the normal size paper sheets P are detectable when the small-paper-sheet guide 126 is removed.

Third Exemplary Embodiment

A medium supply device according to a third exemplary embodiment will now be described. Components that are the same as those in the above-described first and second exemplary embodiments are denoted by the same reference numerals, and description thereof will thus be omitted.

Figure 18:
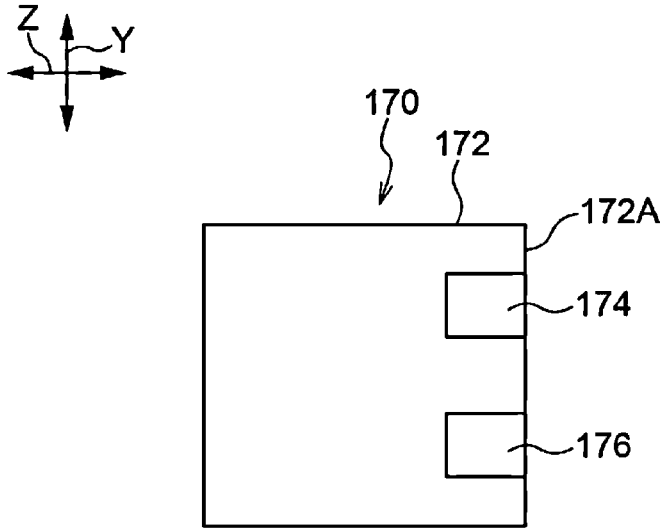
FIG. 18 illustrates the structure of a photoelectric sensor included in a medium supply device according to a third exemplary embodiment.

As illustrated in FIG. 18, the medium supply device according to the third exemplary embodiment includes a photoelectric sensor 170, which is an example of a detection unit, in place of the camera 18 of the medium supply device 10 according to the first exemplary embodiment and the camera 130 of the medium supply device 120 according to the second exemplary embodiment.

The photoelectric sensor 170 includes a housing 172 having an end surface 172A on which a light-emitting portion 174 that emits light and a light-receiving portion 176 that receives light are provided. The photoelectric sensor 170 detects the conditions of the edge portions of the normal size paper sheets P or the small paper sheets SP that are raised and separated from each other by receiving light emitted from light from the light-emitting portion 174 with the light-receiving portion 176. Structures of components other than the photoelectric sensor 170 are similar to those of the medium supply device 10 according to the first exemplary embodiment or the medium supply device 120 according to the second exemplary embodiment.

The medium supply device according to the third exemplary embodiment provides operations described below in addition to operations provided by structures similar to those in the medium supply device 10 according to the first exemplary embodiment or the medium supply device 120 according to the second exemplary embodiment.

In the medium supply device according to the third exemplary embodiment, the photoelectric sensor 170 detects the conditions of the edge portions of the normal size paper sheets P or the small paper sheets SP that are raised and separated from each other by detecting light emitted from the light-emitting portion 174 with the light-receiving portion 176.

Supplementary Information

Although the small-paper-sheet guides 24 and 126 are removably attachable to the side guides 20 and 122 in the medium supply devices according to the first to third exemplary embodiments, the present disclosure is not limited to such a configuration. The small-paper-sheet guides may, for example, be removably attachable to other members, such as a bottom plate of the stacking unit 12.

Although the camera 18, the camera 130, or the photoelectric sensor 170 is provided at each side of the small paper sheets SP in the width direction in the medium supply devices according to the first to third exemplary embodiments, the present disclosure is not limited to such a configuration. The configuration may, for example, be such that the camera 18, the camera 130, or the photoelectric sensor 170 is provided only at one side of the small paper sheets SP in the width direction.

Although the spring 56 or the tension spring 146 is provided as an example of a power unit in the medium supply devices according to the first to third exemplary embodiments, the present disclosure is not limited to such a configuration. The detection unit may, for example, be moved by using a solenoid or a motor as an example of a power unit. In such a case, the solenoid or the motor may, for example, operate to move the detection unit to the displaced position when the small-paper-sheet guide is attached to, for example, the side guide.

Although the medium supply devices according to the first and third exemplary embodiments are configured such that the spring 56 is provided as an example of a power unit and that the detection unit, such as the camera, is moved to the normal position P1 by the operation of the user when each small-paper-sheet guide 24 is removed, the present disclosure is not limited to such a configuration. For example, another power unit may be provided, and the detection unit, such as the camera, may be moved to the normal position P1 by the other power unit when each small-paper-sheet guide 24 is removed.

In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration which are located physically apart from each other but may work cooperatively. The order of operations of the processor is not limited to one described in the embodiments above, and may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

Appendix (((1)))

A medium supply device including:

a stacking unit in which media are stackable in a vertical direction;

a first regulating unit that is provided on the stacking unit and that regulates positions of side portions of the media in a width direction;

a supply unit that supplies air to more than one of the media stacked on the stacking unit so that the more than one of the media are raised and separated from each other;

a transport unit that successively feeds the media that are raised and separated from each other by the supply unit;

a detection unit that detects conditions of the media that are raised and separated from each other by the supply unit from outside in the width direction;

a second regulating unit that is attached to an upper section of the stacking unit when the media stacked in the stacking unit are second media and that regulates positions of side portions of the second media in the width direction, the second media having a smaller dimension than first media in the width direction; and a moving unit that moves the detection unit to an area in which the second media are detectable when the second regulating unit is attached.

(((2)))

The medium supply device according to (((1))), wherein the detection unit is provided on the first regulating unit, and wherein the second regulating unit is removably attachable to the first regulating unit.

(((3)))

The medium supply device according to (((1))) or (((2))), wherein the moving unit includes a power unit that allows movement of the detection unit to a position at which the detection unit faces the side portions of the second media, and wherein the power unit operates in response to attachment of the second regulating unit so that the detection unit moves to the position at which the detection unit faces the side portions of the second media.

(((4)))

The medium supply device according to (((3))), wherein the moving unit causes the power unit to operate to move the detection unit to an area in which the first media are detectable when the second regulating unit is removed.

(((5)))

The medium supply device according to (((3))), wherein the moving unit is configured such that a user performs an operation of moving the detection unit to an area in which the first media are detectable when the second regulating unit is removed.

(((6)))

The medium supply device according to (((3))) or (((5)))

wherein the moving unit includes:

an urging member that serves as the power unit and that urges the detection unit in a direction for moving the detection unit to the area in which the second media are detectable; and a stopper that retains the detection unit in an area in which the first media are detectable against an urging force applied by the urging member, and wherein a contact portion provided on the second regulating unit comes into contact with the stopper to release the detection unit from the stopper.

(((7)))

The medium supply device according to any one of (((1))) to (((6))), wherein the second regulating unit has a cut portion so that detection by the detection unit is not impeded when the detection unit is moved to the area in which the second media are detectable.

(((8)))

The medium supply device according to (((3))) or (((4))), wherein the moving unit includes:

a tension spring that serves as the power unit and that moves the detection unit to an area in which the first media are detectable;

a first inclined surface provided on the detection unit and extending in a direction crossing a direction in which the detection unit moves to the area in which the second media are detectable; and a second inclined surface provided on the second regulating unit, the second inclined surface coming into contact with the first inclined surface and pushing the detection unit to the area in which the second media are detectable against a force applied by the tension spring.

(((9)))

The medium supply device according to any one of (((1))) to (((8))), wherein the second regulating unit is attached at each side of the second media in the width direction, and wherein the detection unit is provided at least at one side of the second media in the width direction.

(((10)))

The medium supply device according to (((9))), wherein the second regulating unit is attached at each side of the second media in the width direction, and wherein the detection unit is provided at each side of the second media in the width direction.

(((11)))

The medium supply device according to any one of (((1))) to (((10))), further comprising:

at least one processor, wherein the processor is configured to change an amount of air supplied by the supply unit based on a result of detection performed by the detection unit.

(((12)))

The medium supply device according to any one of (((1))) to (((11))), wherein the detection unit is an imaging unit that captures an image of edge portions of the first media or the second media that are raised and separated from each other.

(((13)))

The medium supply device according to any one of (((1))) to (((11))), wherein the detection unit is a photoelectric sensor that detects conditions of edge portions of the first media or the second media that are raised and separated from each other by detecting light emitted from a light-emitting portion with a light-receiving portion.

(((14)))

An image forming apparatus including:

the medium supply device according to any one of (((1))) to (((13))); and an image forming unit that forms an image on the first media or the second media supplied by the medium supply device.

What is claimed is:

1. A medium supply device comprising:

a stacking unit in which media are stackable in a vertical direction;

a first regulating unit that is provided on the stacking unit and that regulates positions of side portions of the media in a width direction;

a supply unit that supplies air to more than one of the media stacked on the stacking unit so that the more than one of the media are raised and separated from each other;

a transport unit that successively feeds the media that are raised and separated from each other by the supply unit;

a detection unit that detects conditions of the media that are raised and separated from each other by the supply unit from outside in the width direction;

a second regulating unit that is attached to an upper section of the stacking unit when the media stacked in the stacking unit are second media and that regulates positions of side portions of the second media in the width direction, the second media having a smaller dimension than first media in the width direction; and a moving unit that moves the detection unit in a horizontal direction to an area in which the second media are detectable when the second regulating unit is attached, wherein the moving unit includes a power unit that allows movement of the detection unit to a position at which the detection unit faces the side portions of the second media, and wherein the power unit operates in response to attachment of the second regulating unit so that the detection unit moves to the position at which the detection unit faces the side portions of the second media.

2. The medium supply device according to claim 1, wherein the detection unit is provided on the first regulating unit, and wherein the second regulating unit is removably attachable to the first regulating unit.

3. The medium supply device according to claim 1, wherein the moving unit causes the power unit to operate to move the detection unit to an area in which the first media are detectable when the second regulating unit is removed.

4. The medium supply device according to claim 1, wherein the moving unit is configured such that a user performs an operation of moving the detection unit to an area in which the first media are detectable when the second regulating unit is removed.

5. The medium supply device according to claim 1, wherein the moving unit includes:

an urging member that serves as the power unit and that urges the detection unit in a direction for moving the detection unit to the area in which the second media are detectable; and a stopper that retains the detection unit in an area in which the first media are detectable against an urging force applied by the urging member, and wherein a contact portion provided on the second regulating unit comes into contact with the stopper to release the detection unit from the stopper.

6. The medium supply device according to claim 1, wherein the second regulating unit has a cut portion so that detection by the detection unit is not impeded when the detection unit is moved to the area in which the second media are detectable.

7. The medium supply device according to claim 1, wherein the moving unit includes:

a tension spring that serves as the power unit and that moves the detection unit to an area in which the first media are detectable;

a first inclined surface provided on the detection unit and extending in a direction crossing a direction in which the detection unit moves to the area in which the second media are detectable; and a second inclined surface provided on the second regulating unit, the second inclined surface coming into contact with the first inclined surface and pushing the detection unit to the area in which the second media are detectable against a force applied by the tension spring.

8. The medium supply device according to claim 1, wherein the second regulating unit is attached at each side of the second media in the width direction, and wherein the detection unit is provided at least at one side of the second media in the width direction.

9. The medium supply device according to claim 8, wherein the second regulating unit is attached at each side of the second media in the width direction, and wherein the detection unit is provided at each side of the second media in the width direction.

10. The medium supply device according to claim 1, further comprising:

at least one processor, wherein the processor is configured to change an amount of air supplied by the supply unit based on a result of detection performed by the detection unit.

11. The medium supply device according to claim 1, wherein the detection unit is an imaging unit that captures an image of edge portions of the first media or the second media that are raised and separated from each other.

12. The medium supply device according to claim 1, wherein the detection unit is a photoelectric sensor that detects conditions of edge portions of the first media or the second media that are raised and separated from each other by detecting light emitted from a light-emitting portion with a light-receiving portion.

13. An image forming apparatus comprising:

the medium supply device according to claim 1; and an image forming unit that forms an image on the first media or the second media supplied by the medium supply device.

14. An image forming apparatus comprising:

the medium supply device according to claim 2; and an image forming unit that forms an image on the first media or the second media supplied by the medium supply device.

15. An image forming apparatus comprising:

the medium supply device according to claim 3; and an image forming unit that forms an image on the first media or the second media supplied by the medium supply device.

16. An image forming apparatus comprising:

the medium supply device according to claim 4; and an image forming unit that forms an image on the first media or the second media supplied by the medium supply device.

17. An image forming apparatus comprising:

the medium supply device according to claim 5; and an image forming unit that forms an image on the first media or the second media supplied by the medium supply device.

18. An image forming apparatus comprising:

the medium supply device according to claim 6; and an image forming unit that forms an image on the first media or the second media supplied by the medium supply device.

* * * * *